US008850636B2

(12) United States Patent
Gray

(10) Patent No.: US 8,850,636 B2
(45) Date of Patent: Oct. 7, 2014

(54) PERSONAL INDEPENDENT MOBILITY AND LIFT DEVICE

(71) Applicant: David C. Gray, Murfreesboro, TN (US)

(72) Inventor: David C. Gray, Murfreesboro, TN (US)

( * ) Notice: Subject to any disclaimer, the term of this patent is extended or adjusted under 35 U.S.C. 154(b) by 0 days.

(21) Appl. No.: 14/054,157

(22) Filed: Oct. 15, 2013

(65) Prior Publication Data

US 2014/0109312 A1 Apr. 24, 2014

Related U.S. Application Data

(63) Continuation of application No. 13/928,238, filed on Jun. 26, 2013, now abandoned.

(60) Provisional application No. 61/664,520, filed on Jun. 26, 2012.

(51) Int. Cl.
*A61G 7/10* (2006.01)
*A61G 5/14* (2006.01)
*A61G 5/04* (2013.01)

(52) U.S. Cl.
CPC ... *A61G 5/14* (2013.01); *A61G 5/04* (2013.01)
USPC ..... 5/86.1; 5/83.1; 5/81.1 R

(58) Field of Classification Search
USPC ..... 5/86.1, 83.1, 81.1 R, 87.1; 297/170–174, DIG. 4, DIG. 10; 280/11, 280/250.1
See application file for complete search history.

(56) References Cited

U.S. PATENT DOCUMENTS

| | | | | |
|---|---|---|---|---|
| 8,468,622 | B2 * | 6/2013 | Purwar et al. | 5/86.1 |
| 2005/0217025 | A1 * | 10/2005 | Barattia | 5/86.1 |
| 2008/0189852 | A1 * | 8/2008 | Gramkow et al. | 5/85.1 |
| 2012/0023661 | A1 * | 2/2012 | Ota et al. | 5/86.1 |
| 2012/0047648 | A1 * | 3/2012 | Purwar et al. | 5/86.1 |
| 2012/0151674 | A1 * | 6/2012 | McKenney | 5/86.1 |
| 2012/0255118 | A1 * | 10/2012 | Hammond et al. | 5/86.1 |
| 2013/0111660 | A1 * | 5/2013 | Wilson | 5/86.1 |

* cited by examiner

*Primary Examiner* — Brittany Wilson
(74) *Attorney, Agent, or Firm* — Hulsey Calhoun, PC; William N. Hulsey

(57) ABSTRACT

A mobility device with sit and stand assist for providing disabled individuals with the ability to rise from a sitting position and move about without the aid of an assistant. The mobility device with sit and stand assist generally includes a motorized and steerable Drive Carriage Assembly, a Trailing Cart Assembly attached to the Drive Carriage Assembly, an Outrigger Assembly attached to the Trailing Cart Assembly, a Lift Arm Assembly attached to the Outrigger Assembly, a Lift Arm Locking Bolt Assembly attached to the Lift Arm Assembly, a Knee Brace Assembly attached to the Trailing Cart Assembly, a Control Assembly attached to the Lift Arm Assembly, and a User Connection Group comprised of various components designed to enable the user to comfortably connect himself/herself to the Device such that the user might be able to utilize and benefit from the Device.

19 Claims, 18 Drawing Sheets

28
30
32
34
36
38
40
42
44
46
48
50
52
54
56
58
60
62
64
66
68
70
72
74
76
78
80
82
84
86
88
90
92
94
96
98
100
102
104
106
108

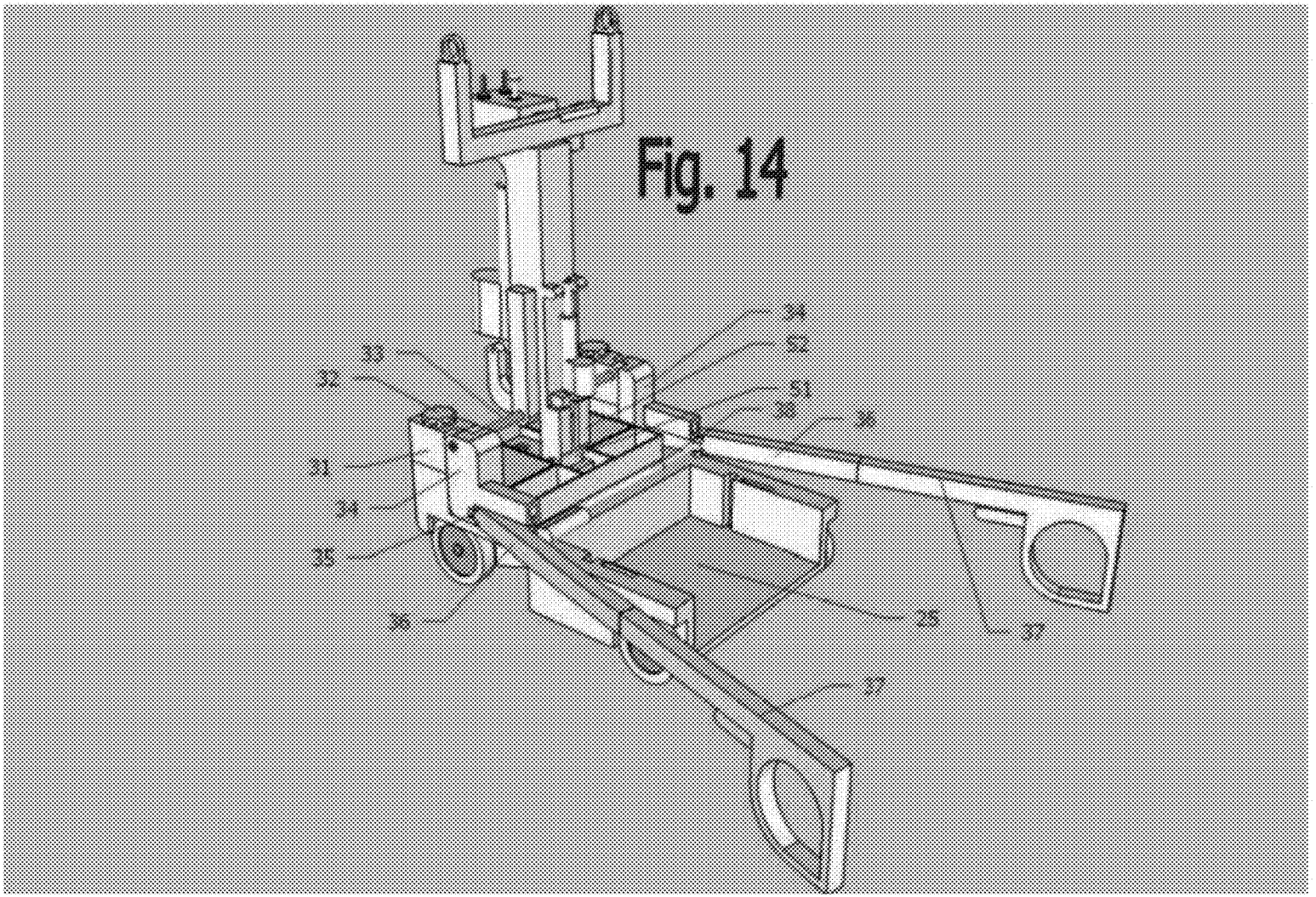
14
26
28
30
32
34
36
38
40
42
44
46
48
50
52
54
56
58
60
62
64
66
68
70
72
74
76
78
80
82
84
86
88
90
92
94
96
98
100
102
104

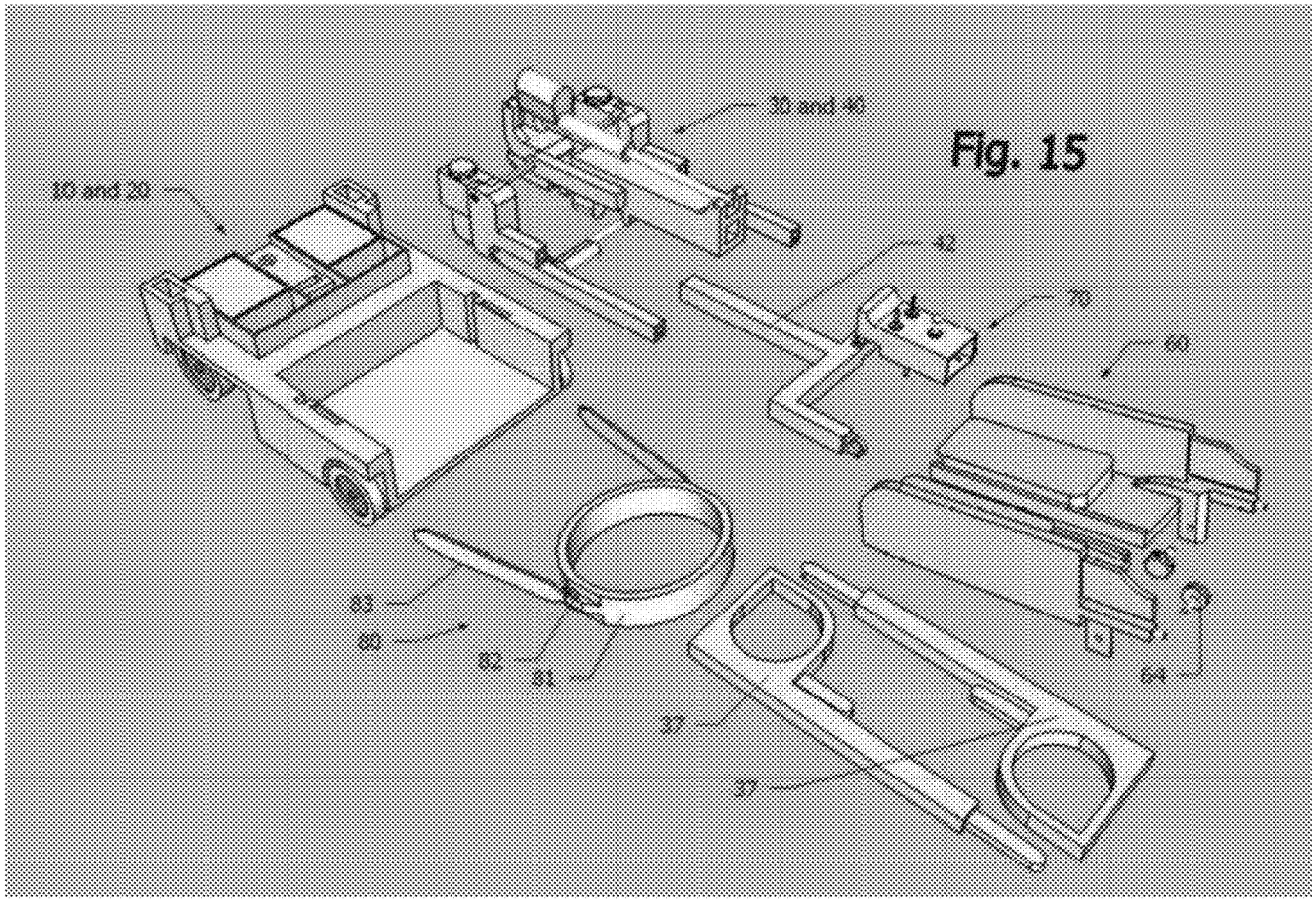
20 and 22
20 and 22
2
2
2

PERSONAL INDEPENDENT MOBILITY AND LIFT DEVICE

CROSS-REFERENCE TO RELATED APPLICATIONS

This application is a continuation of U.S. Nonprovisional application Ser. No. 13/928,238, filed on Jun. 26, 2013, which claims priority to U.S. Provisional Application Ser. No. 61/664,520 filed on Jun. 26, 2012, both of which are hereby incorporated by reference.

BACKGROUND OF THE INVENTION

Medical science has long acknowledged the many health benefits, both physical and psychological, of standing. However, for many disabled people, this is not possible without help which is usually in the form of a caregiver. However, a caregiver is not the answer to every situation, such as if a caregiver is not able to lift the disabled person, if a caregiver cannot be afforded, if the disabled person would like more independence, or if otherwise a caregiver is unavailable.

As a result, patient lift devices have been developed, primarily for use in hospitals, nursing homes, and other institutional settings. These patient lift devices are designed to aid in the transfer of a patient from one location to another, such as from a bed to a wheelchair. Some of these devices are designed to assist a caregiver in moving a patient rather than enabling the patient to perform this function independently. Other devices allow for the patient to stand up without the aid of a caregiver, but do not provide a way for the patient to move about once standing on the device without the aid of a caregiver.

Motorized wheelchairs have also been developed to enable the user to rise from the seated position and move about at a normal standing height. Such wheelchairs lift the user by means of the chair or seating portion being extended upward and straightened into a substantially vertical platform to support the user in the upright or "standing" position. In such a position, most of the mechanical portion of the device is behind the user. These devices require a user to "transfer" from their bed to the device each morning, and from the device into bed each night, and from the device onto the commode and then back onto the device at different times throughout the day.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

BRIEF SUMMARY OF THE INVENTION

The present disclosure relates generally to a mobility device for disabled individuals and more specifically it relates to a mobility device with sit and stand assist for providing disabled individuals with the ability to rise from a sitting position and move about without the aid of an assistant.

The disclosure generally relates to an independence enhancement device with outriggers which includes a motorized and steerable Drive Carriage Assembly (10), a Trailing Cart Assembly (20) attached to the Drive Carriage Assembly (10), an Outrigger Assembly (30) attached to the Trailing Cart Assembly (20), a Lift Arm Assembly (40) attached to the Outrigger Assembly (30), a Lift Arm Locking Bolt Assembly (50) attached to the Lift Arm Assembly (40), a Knee Brace Assembly (60) attached to the Trailing Cart Assembly (20), a Control Assembly (70) attached to the Lift Arm Assembly (40), and a User Connection Group (80) comprised of various components designed to enable the user to comfortably connect himself/herself to the Device (1) such that the user might be able to utilize and benefit from the Device (1).

There has thus been outlined, rather broadly, some of the features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Some embodiments provide a mobility device with sit and stand assist for providing disabled individuals with the ability to rise from a sitting position and move about without the aid of an assistant.

Some embodiments provide a mobility device with sit and stand assist that will give individuals who are unable to stand unassisted from a bed, chair, or commode the option to remain living in their home rather than having to move to a nursing home or other assisted care facility as a result of their disability.

Some embodiments provide a mobility device with sit and stand assist that will enable disabled individuals to rise unassisted from a seated position such as a bed, chair, sofa, commode, etc. and remain standing until they decide to return to a seated position, as is the case for non-disabled individuals.

Some embodiments provide a mobility device with sit and stand assist that will provide the necessary stability to lift an individual from a seated position to a standing position via extendable outriggers that can be lowered into position to facilitate the lifting process, and then raised easily once the standing procedure has been completed making the unit much more compact and maneuverable.

Some embodiments provide a mobility device with sit and stand assist that will, via extendable and vertically elevating outriggers, function effectively even in situations where there is little or no clearance below a particular seating surface as is typically the case with many sofas and recliners, or bed as is typically the case with platform-type beds such as those commonly found in hotels.

Some embodiments provide a mobility device with sit and stand assist that will allow disabled individuals to participate in activities, conversations, and encounters in a standing position rather than from a diminished height as when seated in a wheelchair.

Some embodiments provide a mobility device with sit and stand assist that will provide disabled individuals with the ability to travel at a normal walking speed for extended distances without tiring or fear of sustaining injuries as a result of falling.

Some embodiments provide a mobility device with sit and stand assist that will provide disabled individuals with the ability to enjoy travel by making it possible for them to use chairs and restrooms in restaurants, as well as restrooms, furniture, and beds in hotels, on cruise ships, and in other travel venues.

Some embodiments provide a mobility device with sit and stand assist that can be easily configured to accommodate individuals with a variety of disabilities via interchangeable components such as braces, controls, and user-to-device attachment options.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages that are included within this description, be within the scope of any claims filed later.

BRIEF DESCRIPTIONS OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 14 depicts an upper perspective detail view of one embodiment showing the Lift Arm Locking Bolt (51) in the down/locked position and the Outriggers (36) and thus the Outrigger Extensions (37) in a laterally outward expanded position.

FIG. 15 depicts an upper perspective view of one embodiment of the individual components of the device in a disassembled state as in preparation for transport such as in the trunk of a car.

FIG. 16 (B) depicts a side view of one embodiment illustrating the user in a standing position after the standing process has been completed with the Outrigger Extensions (37) still lowered and in contact with the seating surface.

FIG. 16 (C) depicts a side view of one embodiment illustrating the user in a standing position after the standing process has been completed with the Outrigger Extensions (37) in the upright and stowed position.

Figure 17:
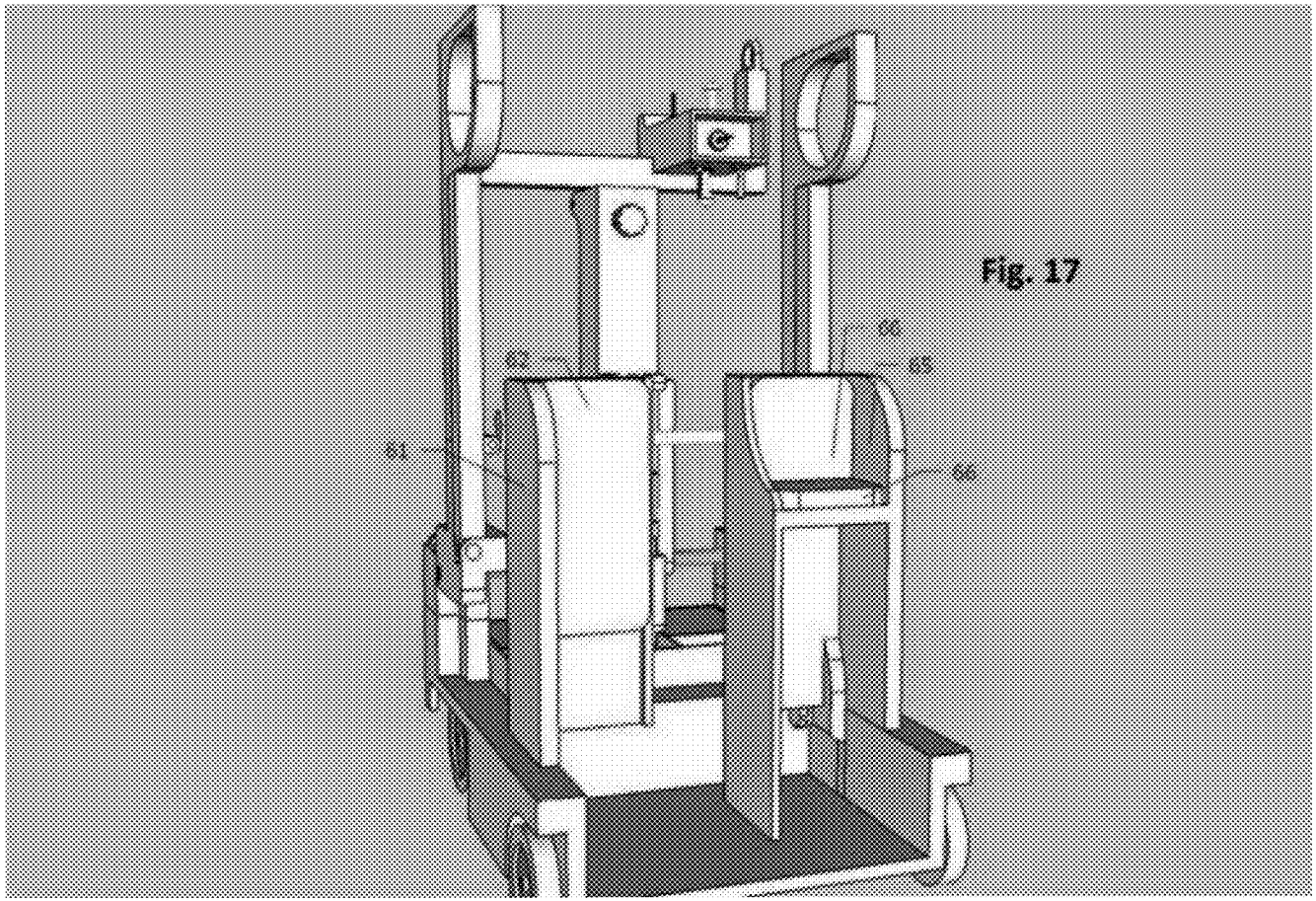
FIG. 17 depicts an upper perspective view of one embodiment of a Knee Brace (61) and a Specialized Leg Support (65) and Leg Support Padding (66) designed as a shelf to provide support for an amputee.
Figure 18:
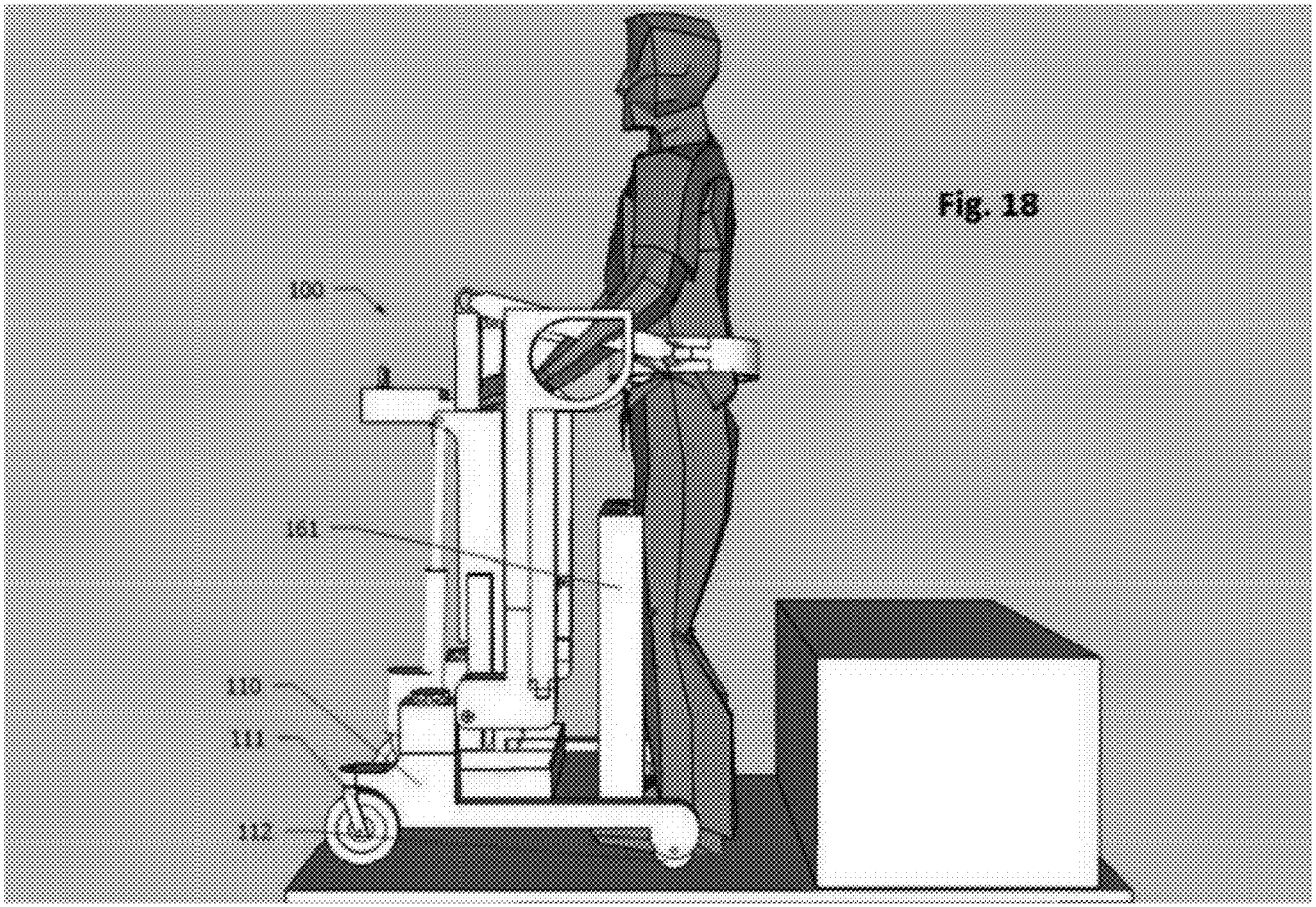

FIG. 18 depicts a side view of one embodiment of the device (100) which is designed to provide the sit-to-stand and stand-to-sit assist functions exactly as does the device (1) illustrated in FIGS. 1-18 of the drawings, but without the components that comprise the motorized user-transportation features of the Device (1), such that the user would stand on the floor and push or pull the device to move from location to location.

In the FIGURES, like elements should be understood to represent like elements, even though reference labels are omitted on some instances of a repeated element, for simplicity.

DETAILED DESCRIPTION OF ILLUSTRATIVE EMBODIMENTS

Reference now should be made to the drawings, in which similar reference numbers used throughout the different figures designate similar components. The FIGURES generally illustrate a motorized and steerable Drive Carriage Assembly (10), a Trailing Cart Assembly (20) attached to the Drive Carriage Assembly (10), an Outrigger Assembly (30)

attached to the Trailing Cart Assembly (20), a Lift Arm Assembly (40) attached to the Outrigger Assembly (30), a Lift Arm Locking Bolt Assembly (50) attached to the Lift Arm Assembly (40), a Knee Brace Assembly (60) attached to the Trailing Cart Assembly (20), a Control Assembly (70) attached to the Lift Arm Assembly (40), and a User Connection Group (80) comprised of various components designed to enable the user to comfortably connect himself/herself to the Device (1) such that the user might be able to utilize and benefit from the Device (1).

Drive Carriage Assembly

The Drive Carriage Assembly (10) is comprised of a Body (11) upon which are mounted a Connecting Pin (12), two independently controlled and reversible motor-driven Motorized Drive Wheels (13), and a Steering Limiter (14).

Figure 2:
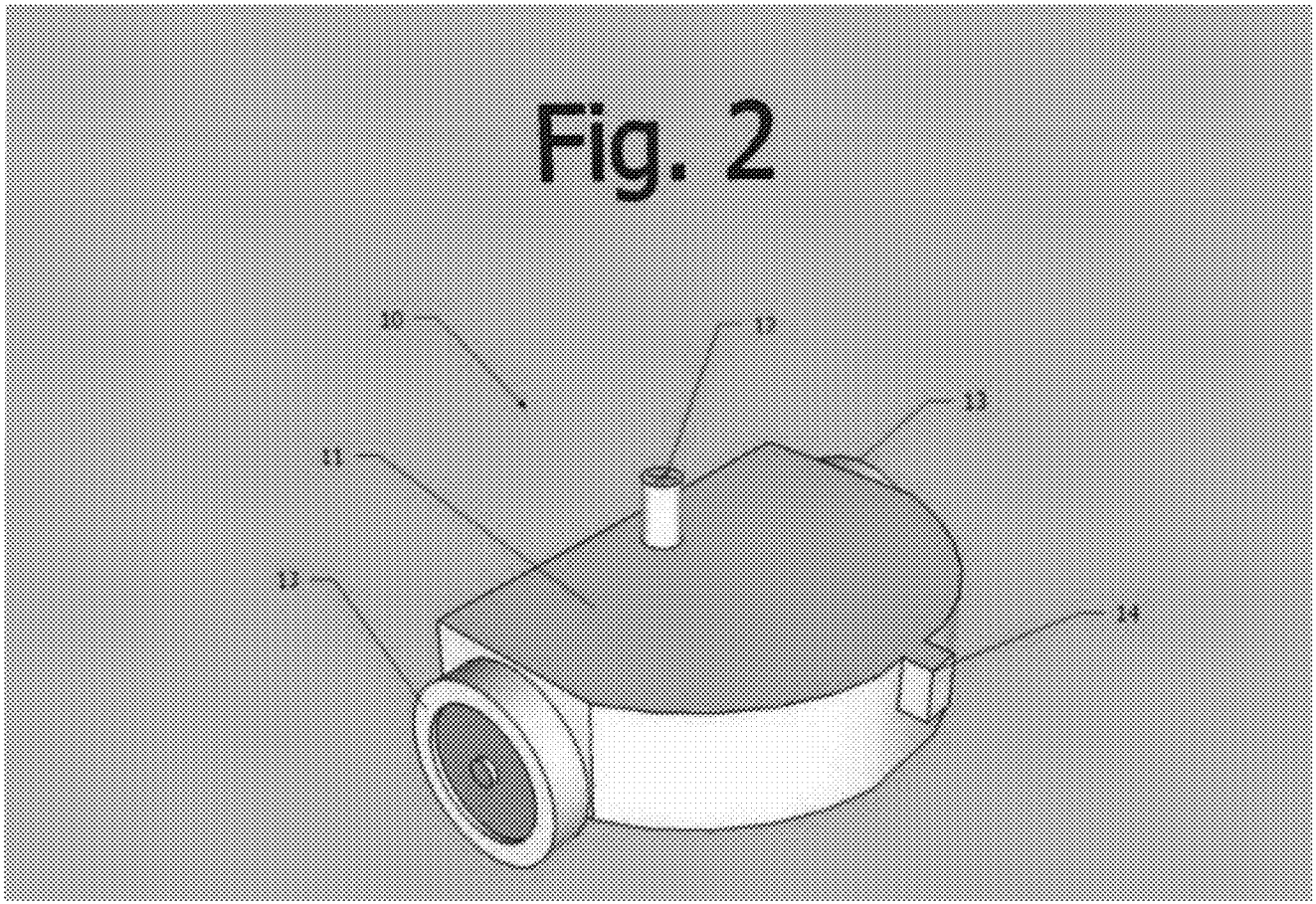
FIG. 2 depicts an exploded upper perspective view of one embodiment of the Drive Carriage (10) as it would appear when removed from the Device (1).
Figure 4:
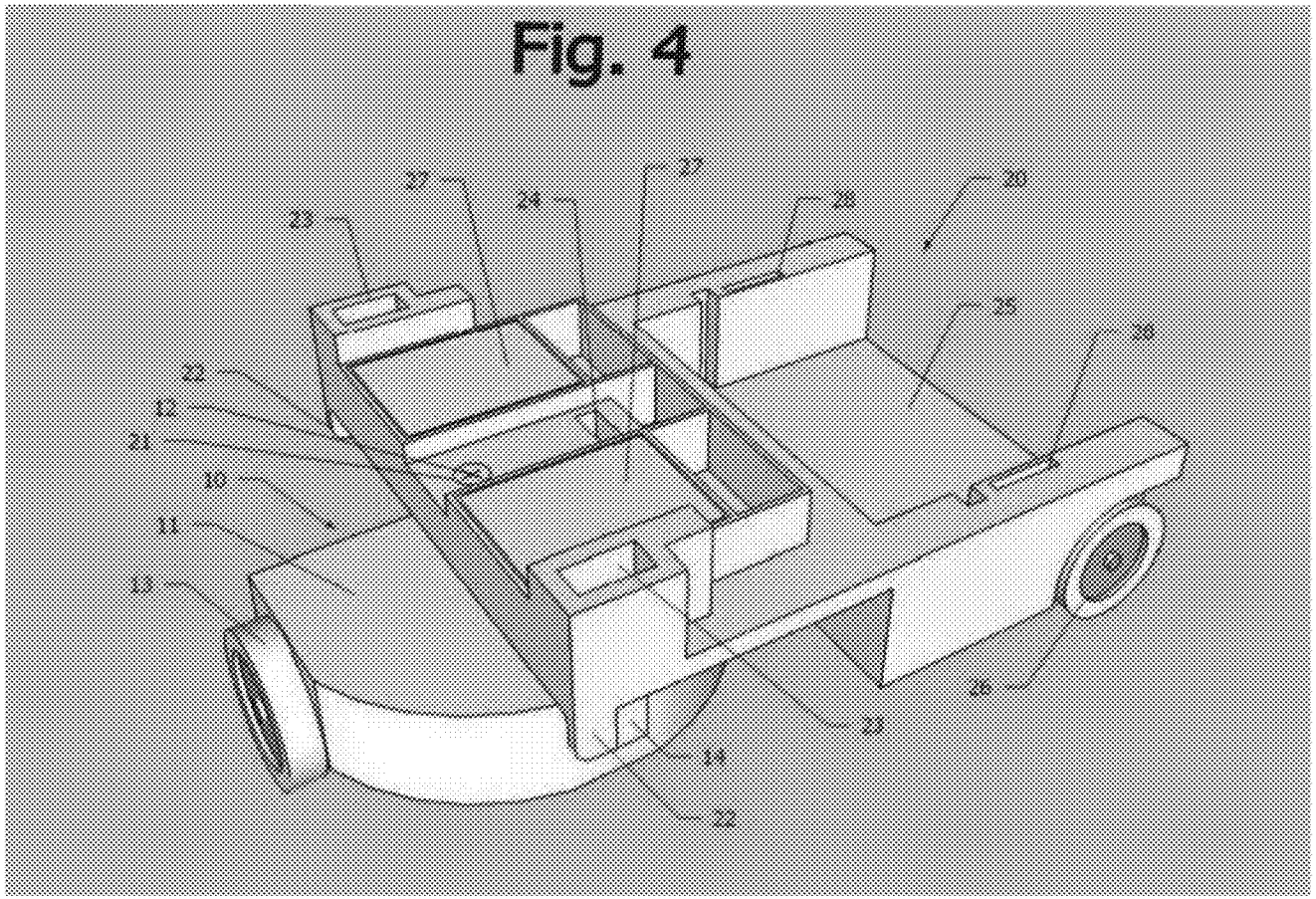
FIG. 4 depicts an exploded upper perspective view of one embodiment of the Drive Carriage (10) connected to the Trailing Cart (11) in the full right steering position to illustrate the function of the Steering Limiter (14) as it contacts the Steering Stop (22) to prevent further steering rotation of the Drive Carriage (10).

As seen in FIGS. 2 and 4 of the drawings, the Drive Carriage Assembly (10) is an assembly of components designed to provide drive and steering capability for the Device (1). In some embodiments, the primary such component of the Drive Carriage Assembly (10) is the Body (11), a rigid structure featuring a vertical Connecting Pin (12) solidly attached in a forward central position upon the upper horizontal surface of the Body (11). In some embodiments, the Connecting Pin (12) provides a pivotal point of attachment between the Drive Carriage Assembly (10) and the Trailing Cart Assembly (20) that will allow the Drive Carriage Assembly (10) to pivot horizontally in relation to the position of the Trailing Cart Assembly (20). Also attached to the Body (11) of some embodiments is a set of Motorized Drive Wheels (13), for example two Motorized Drive Wheels, which may be positioned parallel to each other on laterally opposite vertical surfaces of the Body (11) such that when both Motorized Drive Wheels (13) are engaged and rotating at the same speed in a forward direction in relation to the Trailing Cart Assembly (20), the Trailing Cart Assembly (20) will be pulled in a forward direction. While two Motorized Drive Wheels (13) are used in the present embodiment, other embodiments may use any number of Motorized Drive Wheels (13) in any positions. Steering for the Device (1) may be achieved when one or more of the set of Motorized Drive Wheels (13) is caused to rotate at a higher speed than the other Motorized Drive Wheels (13), causing the Drive Carriage Assembly (10) to pivot about the Connecting Pin (12) as seen in FIG. 4 of the drawings and thus the Trailing Cart (20) to be pulled in a particular direction, for example, to the right or left. Steering for the Device (1) may be achieved in other embodiments when the Drive Carriage Assembly (10) is rotated to pivot about the Connecting Pin (12). Also attached to the Body (11) of some embodiments is a Steering Limiter (14) positioned in such a manner as to engage at least one of one or more Steering Stops (22), which may be mounted on the Trailing Cart Assembly (20) in order to prevent the Drive Carriage Assembly (10) from rotating about the Connecting Pin (12) in any direction in excess of a predetermined amount. For example, in some embodiments, the Steering Limiter (14) is positioned in such a manner as to engage one of two Steering Stops (22), to prevent the Drive Carriage Assembly (10) from rotating about the Connecting Pin (12) in either direction in excess of approximately 90 degrees from center.

The structure of the Drive Carriage Assembly may vary significantly depending on any number of factors including but not limited to anticipated weight requirements and where the Device (1) will be used. For example, if the Device (1) is constructed to accommodate users with a maximum body weight of 250 lbs and operated exclusively on smooth floors such as those typically found in a home or health care facility, lighter weight materials, wheels, and motors may be used in its construction than if the maximum capacity was to be 500 lbs and expected use was to include outdoor environments such as hiking trails. The dimensions of the Drive Carriage Assembly (10) may also vary significantly in order to accommodate larger Motorized Drive Wheels (13) or even more powerful options such as heavy-duty gearmotors, which could be housed within the Body (11) to power the drive wheels. Also, the design of the Steering Limiter (14) may vary in a number of ways. One such variation would involve placing the Steering Limiter (14) on the upper surface of the Body (11) and the Steering Stop (22) on the lower corresponding surface of the Trailing Cart Assembly (20).

Trailing Cart Assembly

In some embodiments, the Trailing Cart Assembly (20) is the base of the Device (1), and includes the necessary components to attach, support, and accommodate either directly or indirectly the other main elements comprising the Device (1). The Trailing Cart Assembly (20) of some embodiments may serve to transport the user of the device and to position the device in such a manner as to be available and functional to the user.

Figure 3:
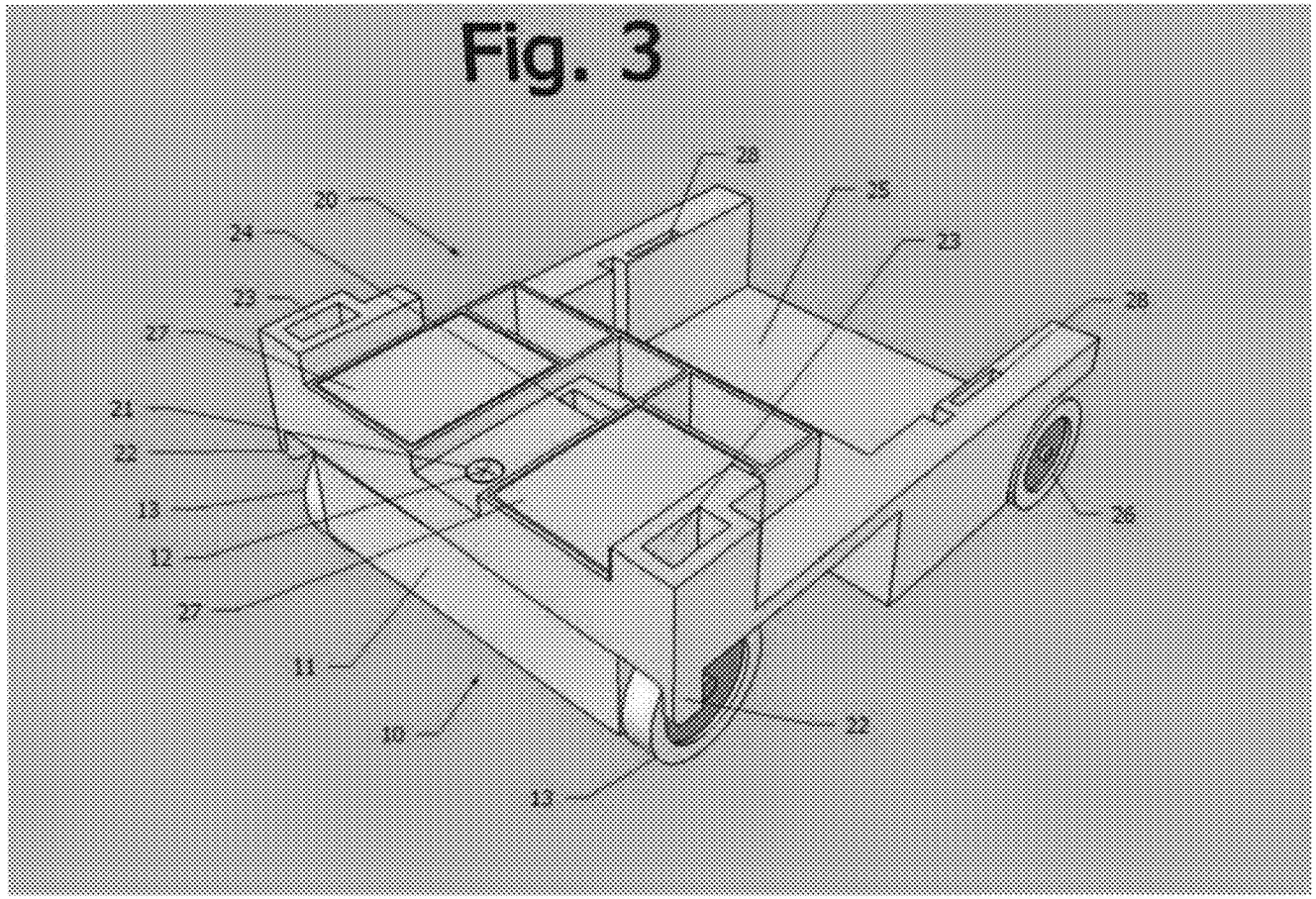
FIG. 3 depicts an exploded upper perspective view of one embodiment of the Trailing Cart (20) connected to the Drive Carriage (10) as they would appear when removed from the Device (1).
Figure 10:
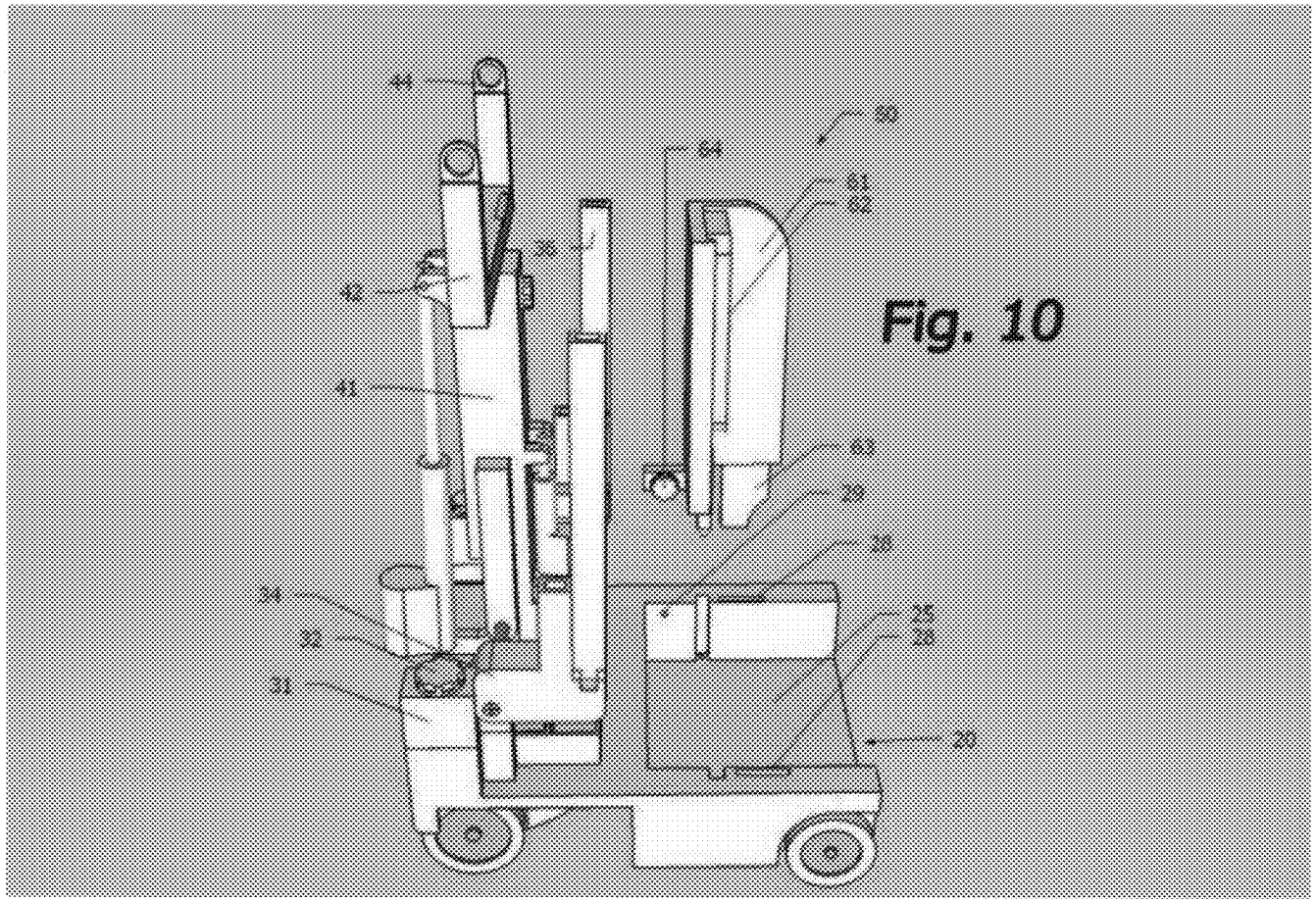
FIG. 10 depicts an exploded upper perspective view of one embodiment of the right side portion of the Knee Brace Assembly (60) showing only the right side Knee Brace (61), the right side Knee Padding (62), the right side Knee Brace Support (63), and the right side Knee Brace Fastener (64).

As seen in FIG. 3 of the drawings, the Trailing Cart Assembly (20) of some embodiments is a specially designed cart supported at the front by the Drive Carriage Assembly (10) and at each rear corner by one or more Trailing Wheels (26), for example, two trailing wheels. The Trailing Cart Assembly (20) of some embodiments is pulled and steered by the Drive Carriage Assembly (10) and may include components and features designed to accept, support, accommodate, and facilitate the other elements and sub-elements of the Device (1). One such component of the Trailing Cart Assembly (20) in some embodiments is the Connecting Bearing (21), which accepts and supports the Connecting Pin (12) of the Drive Carriage Assembly (10). Another component of the Trailing Cart Assembly (20) of some embodiments is the Steering Stop (22), which facilitates the function of the Steering Limiter (14) of the Drive Carriage Assembly (10). Another component of the Trailing Cart Assembly (20) of some embodiments is the Support Block Receiver (23) which accepts and supports the Support Block (31) directly, and thus the connected Outrigger Assembly (30) indirectly, the connected Lift Arm Assembly (40) indirectly, the connected Lift Arm Locking Bolt Assembly (50) indirectly, the connected Control Assembly (70) indirectly, and the connected User Connection Group (80) indirectly. Another component of the Trailing Cart Assembly (20) of some embodiments is the Lock Bolt Receiver (24), which accepts and facilitates the function of the Lift Arm Locking Bolt (51). Another component of the Trailing Cart Assembly (20) of some embodiments is the Standing Platform (25) where the user may place his/her feet during the sit-to-stand procedure and where the user may stand while using the mobility feature Device (1). Another component of the Trailing Cart Assembly (20) in some embodiments is the Trailing Wheels (26). Another component of the Trailing Cart Assembly (20) in some embodiments is the Batteries (27), which supply electrical power to and thus facilitate the function of the Motorized Drive Wheels (13), the Outrigger Spreader Actuator (38), the Main Linear Actuator (47), the Locking Bolt Actuator (53), and the Control Assembly (70). Another component of the Trailing Cart Assembly (20) are the Knee Brace Receivers (28), which accept and support the Knee Brace Assembly (60). Another component of the Trailing Cart Assembly (20) in the embodiment shown in FIG. 10 is the Knee Brace Fastener Receivers (29), which accept the Knee Brace Fasteners (64) to secure the Knee Braces (61).

The structure of the Trailing Cart Assembly (20) may vary significantly depending on any number of factors including but not limited to anticipated weight requirements and where the Device (1) will be used. For example, if the Device (1) is constructed to accommodate users with a maximum body weight of 250 lbs and operated exclusively on smooth floors such as those typically found in a home or health care facility, lighter weight materials, wheels, and motors may be used in its construction than if the maximum capacity was to be 500 lbs and expected use was to include outdoor environments such as hiking trails. The structure of the Trailing Cart Assembly (20) may also vary significantly in order to accommodate larger or wider Trailing Wheels (26). Also, the structure of the Support Block Receivers (23), the Lock Bolt Receiver (24), the Knee Brace Receivers (28), and the Knee Brace Fastener Receivers (29) may vary in a number of ways. One such variation may involve changing the shape of the Lock Bolt Receiver (24) to a shape other than rectangular to accommodate and receive a Lift Arm Locking Bolt (51) of some shape other than rectangular. Similar variations in size and shape could also apply to the Support Block Receivers (23), the Knee Brace Receivers (28), and the Knee Brace Fastener Receivers (29). Structural variations for the Standing Platform (25) could include any number of variations, including but not limited to variations in size, shape, height, materials, and/or coatings applied to the surface of the Standing Platform (25) to make the Standing Platform (25) safer and/or more comfortable.

Outrigger Assembly

Figure 5:
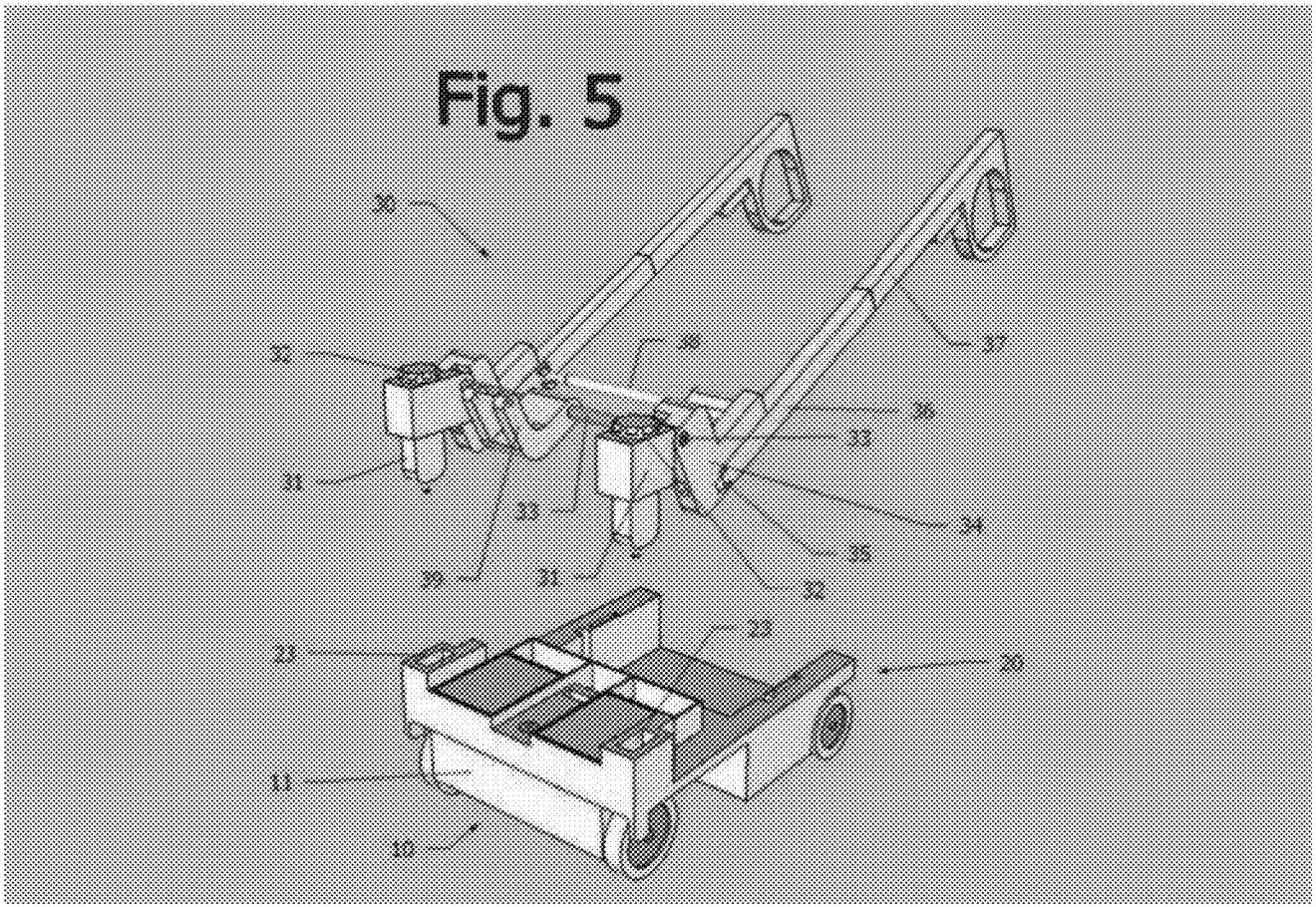
FIG. 5 depicts an exploded upper perspective view of one embodiment of the outrigger assembly (30) separated from the Trailing Cart (20).
Figure 7:
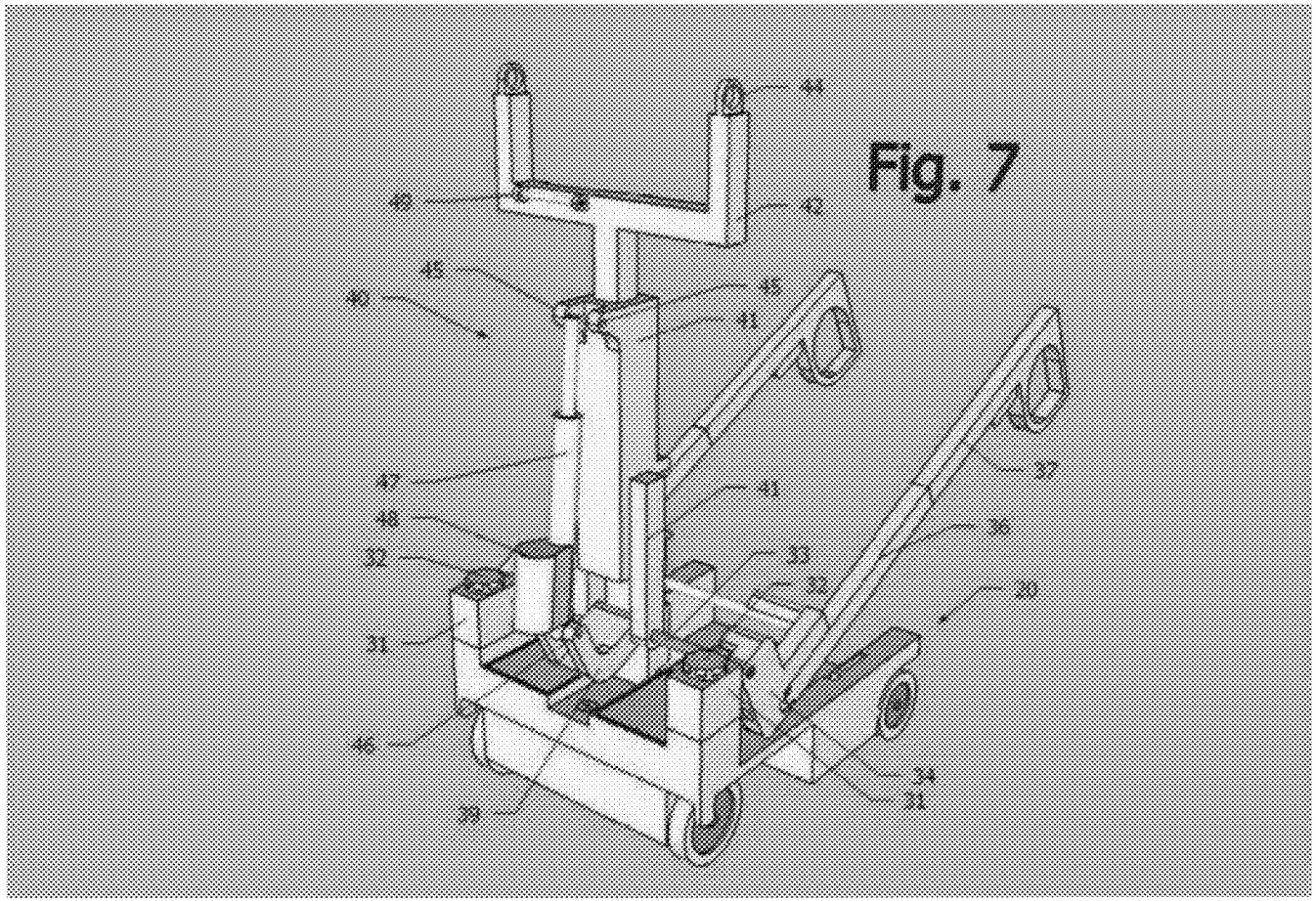
FIG. 7 depicts an upper perspective view of one embodiment of the Lift Arm Assembly (40) in the fully upright position showing the Main Linear Actuator (47) connected to the Lift Arm (41) at the Main Actuator Pivot (45) and to the Outrigger Lever (39) at the Outrigger Lever Pivot (46).

The Outrigger Assembly (30) of some embodiments increases the stability of the Device (1) during the seating and standing procedures. As seen in FIGS. 5 and 7, the Outrigger Assembly (30) of some embodiments includes one or more Support Blocks (31), for example two, which are specially designed to attach to the corresponding Support Block Receivers (23) on the Trailing Cart (20) where each Support Block (31) would be secured in place by a Support Block Fastener (32). Each Support block (31) is pivotably attached to the Outrigger Fulcrum Bar (33), for example, one may be attached at a point between the center of the Outrigger Fulcrum Bar (33) and one end of the Outrigger Fulcrum Bar (33) and the other may be attached at a point between the center of the Outrigger Fulcrum Bar (33) and the opposite end of the Outrigger Fulcrum Bar (33). In this embodiment, attachment in this manner secures the Outrigger Fulcrum Bar (33) and thus the Outrigger Assembly (30) to the Trailing Cart (20) yet allows the remaining components of the Outrigger Assembly (30) to pivot freely about an axis created by the Outrigger Fulcrum Bar (33). At each end of the Outrigger Fulcrum Bar (33) of some embodiments is solidly attached a specially designed Outrigger Block (34) which may include an Outrigger Lateral Hinge (35) to which an Outrigger (36) may be attached in such a manner as to allow the unattached end of the Outrigger (36) to move outwardly away from the Trailing Cart Assembly (20) or return inwardly to its original position in line with the side of the Trailing Cart Assembly (20). The unattached end of each Outrigger (36) may be shaped in such a way as to accept and support one end of either of two Outrigger Extensions (37), thus significantly extending the functional length of each Outrigger (36). In some embodiments, positioned between and attached to one Outrigger (36) at each of its opposite ends is the Outrigger Spreader Actuator (38), a mechanical device capable of exerting both outward and inward force upon the Outriggers (36) causing the distance between the unattached ends of the Outriggers (36) and thus the Outrigger Extensions (37) to increase as the Outrigger Spreader Actuator (38) is extended in length or to decrease as the Outrigger Spreader Actuator (38) is contracted in length. This allows the user to easily increase or decrease the distance between the Outrigger Extensions (37) to accommodate such factors as available space and width of the seating surface.

Some embodiments include an Outrigger Lever (39). For example, in some embodiments, at a point substantially midway between the two outer ends of the Outrigger Fulcrum Bar (33) and thus between the two Support Blocks (31) and extending forward in essentially the opposite direction as the Outriggers (36) is solidly attached the Outrigger Lever (39). Because both the Outrigger Lever (39) and the Outrigger Blocks (34) and thus the Outriggers (36) are solidly attached to the Outrigger Fulcrum Bar (33), downward force on the Outrigger Lever (39) is converted to upward force on the Outriggers (36) and upward force on the Outrigger Lever (39) is converted to downward force on the Outriggers (36) as the Outrigger Fulcrum Bar (33) pivots through the two Support Blocks (31) attached to the Trailing Cart Assembly (20) at the Support Block Receivers (23) via the Support Block Fasteners (32).

The Outrigger Assembly (30) may vary in structure to accommodate an increase in the maximum weight capacity for the Device (1), as the user's entire weight as well as the full weight of the Lift Arm Assembly (40), the full weight of the Lift Arm Locking Bolt Assembly (50), the full weight of the Control Assembly (70), and the combined weight of any components of the User Connection Group (80) employed by the user must be supported by the Outrigger Assembly (30) as that total weight is transferred through the Outrigger Lever (39) to the Outrigger Fulcrum Bar (33), then to the Outrigger Blocks (34), through the Outrigger Lateral Hinges (35) to the Outriggers (36), then to the Outrigger Extensions (37) and finally to an existing weight bearing surface such as the floor, bed, or other seating surface upon which the Outrigger Extensions (37) have been placed. Any of those components will fail if insufficient in strength by inadequate design, composition, material, or structure, possibly resulting in a failure of the entire Outrigger Assembly (30) and thus the Device (1) itself creating the potential for injury to the user. Furthermore, the design, composition, material, and structure of the Outrigger Extensions (37) may vary to enable the device to be used for any number of a variety of functions including, but not limited to facilitating entry into and egress from a bathtub or a vehicle, etc. In some embodiments, the Outrigger Extensions (37) are designed to be interchangeable either individually or as a set. Additional variations are certainly possible and anticipated, and will function with the Device (1) provided they adequately extend the functional length of the Outriggers (36) to a point where the stability of the Device (1) is maintained throughout the standing-to-seated and seated-to-standing procedures. In some embodiments, the Spreader Actuator (38) may be replaced with any mechanical device capable of increasing and decreasing the distance between the two Outriggers (36) for example a hydraulic or pneumatic cylinder, a combination of such mechanisms arranged to provide user-controlled outward and inward movement of the Outriggers (36) either together or individually, etc. Other embodiments might eliminate the Spreader Actuator (38) entirely in favor of the position of one or both of the Outriggers (36) being determined or adjusted manually by the user. The design, composition, material or structure of the Outrigger Lever (39) may vary for any number of reasons including, but not limited to variations to maintain optimum functionality or even gain a measure of mechanical advantage and/or range of motion if necessary to accommodate possible variations of mechanical devices employed to perform the duties of the Main Linear Actuator (47).

Lift Arm Assembly

Figure 6:
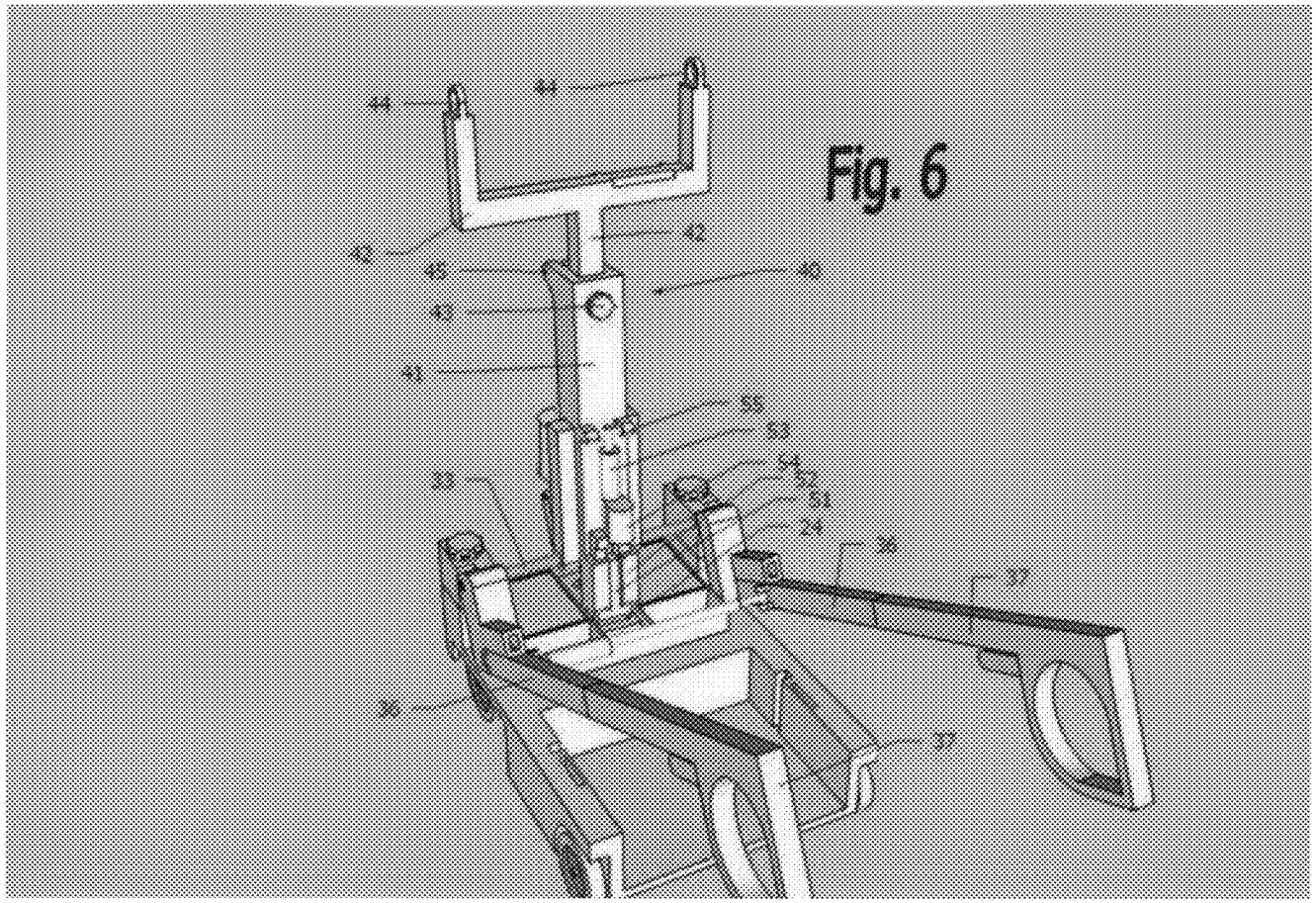
FIG. 6 depicts an upper perspective view of one embodiment of the Lift Arm Assembly (40) in the fully upright position.

As seen in FIGS. 6 and 7, the Lift Arm Assembly (40) of some embodiments is comprised of a Lift Arm (41) connected to the Outrigger Assembly (30) via the Outrigger Fulcrum Bar (33) passing through two sets of bearings, each positioned in the lower end of the Lift Arm (41) with one bearing on either side of the Outrigger Lever (39) such that the upper and unattached end of the Lift Arm (41) will pivot forward away from the user or backward toward the user. While some embodiments use two sets of bearings in the lower end of the lift arm, other embodiments may use any number of bearings in any number of positions to allow for various movements. At the upper and unattached end of the Lift Arm (41) of some embodiments is an opening capable of accepting and supporting the lower end of the Lift Arm Extension (42). The Lift Arm Extension (42) of some embodiments is capable of extending the functional length of the Lift Arm (41) when such additional length would enhance the user's comfort. During the seated-to-standing procedure, when the Lift Arm (41) is lowered to a position sufficiently near the user, the Lift Arm Extension (42) of some embodiments can be either extended outward or retracted inward for maximum user comfort and secured in the desired position by the Lift Arm Adjustment Fastener (43). Adjustment of the Lift Arm Extension (42) is achieved in some embodiments by the user first loosening the Lift Arm Adjustment Fastener (43), then pulling the Lift Arm Extension (42) outward from or pushing the Lift Arm Extension (42) inward into the Lift Arm (41), and then tightening the Lift Arm Adjustment Fastener (43) to secure the Lift Arm Extension (42) in the desired position. Attached to the upper end of the Lift Arm (41) of some embodiments, at the Main Actuator Pivot (45) is the Main Linear Actuator (47), a common mechanical device capable of providing both an outwardly pushing force when extended and an inwardly pulling force when contracted. The Main Linear Actuator (47) in some embodiments is attached at its lower end to the Outrigger Lever (39) at the Outrigger Lever Pivot (46). The Main Linear Actuator (47) in some embodiments may be extended or contracted, creating greater or lesser distance between the outer extremities of the Outrigger Extensions (37) and the Lift Arm Extension (42). When the user is connected to the Device (1) of these embodiments, this change in distance between the Lift Arm Extension (42) and the Outrigger Extensions (37) results in a proportionate increase or decrease in the distance between the user and the seating surface resulting in the user's position being changed from standing to seated or from seated to standing.

As with the Outrigger Assembly (30), the Lift Arm Assembly (40) may vary in structure to accommodate an increase in the maximum weight capacity for the Device (1). The Main Linear Actuator (47) may be replaced with any mechanical device capable of increasing and decreasing under load the distance between the upper end of the Lift Arm (41) and the Outrigger Lever (39), including but not limited to a hydraulic or pneumatic cylinder, a combination of such and other mechanisms arranged to provide user-controlled increase and decrease in distance between the outer extremities of the Lift Arm Extension (42) and Outrigger Extensions (37). Variations in the design, composition, material, and/or structure of the Lift Arm Extension (42) are anticipated in order to accept and accommodate anticipated variations in methods and means of User Connection employed to comfortably and safely connect and secure to the Device (1) various individual users with a diverse range of physical needs and limitations.

Lift Arm Locking Bolt Assembly

Figure 8:
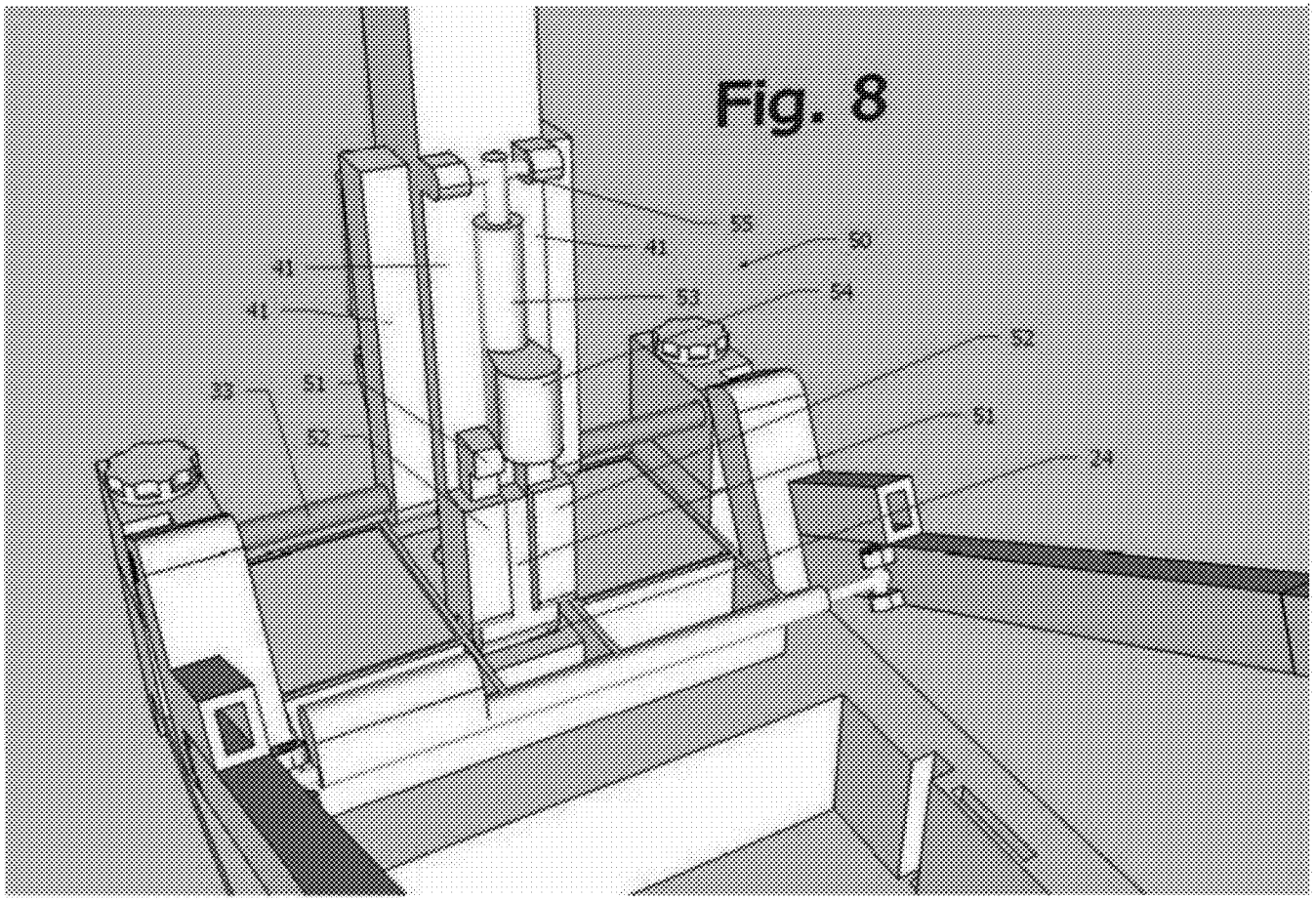
FIG. 8 depicts an upper perspective detail view of one embodiment of the Lift Arm Locking Bolt Assembly (50) with the Lift Arm Locking Bolt (51) in the up/unlocked position.
Figure 9:
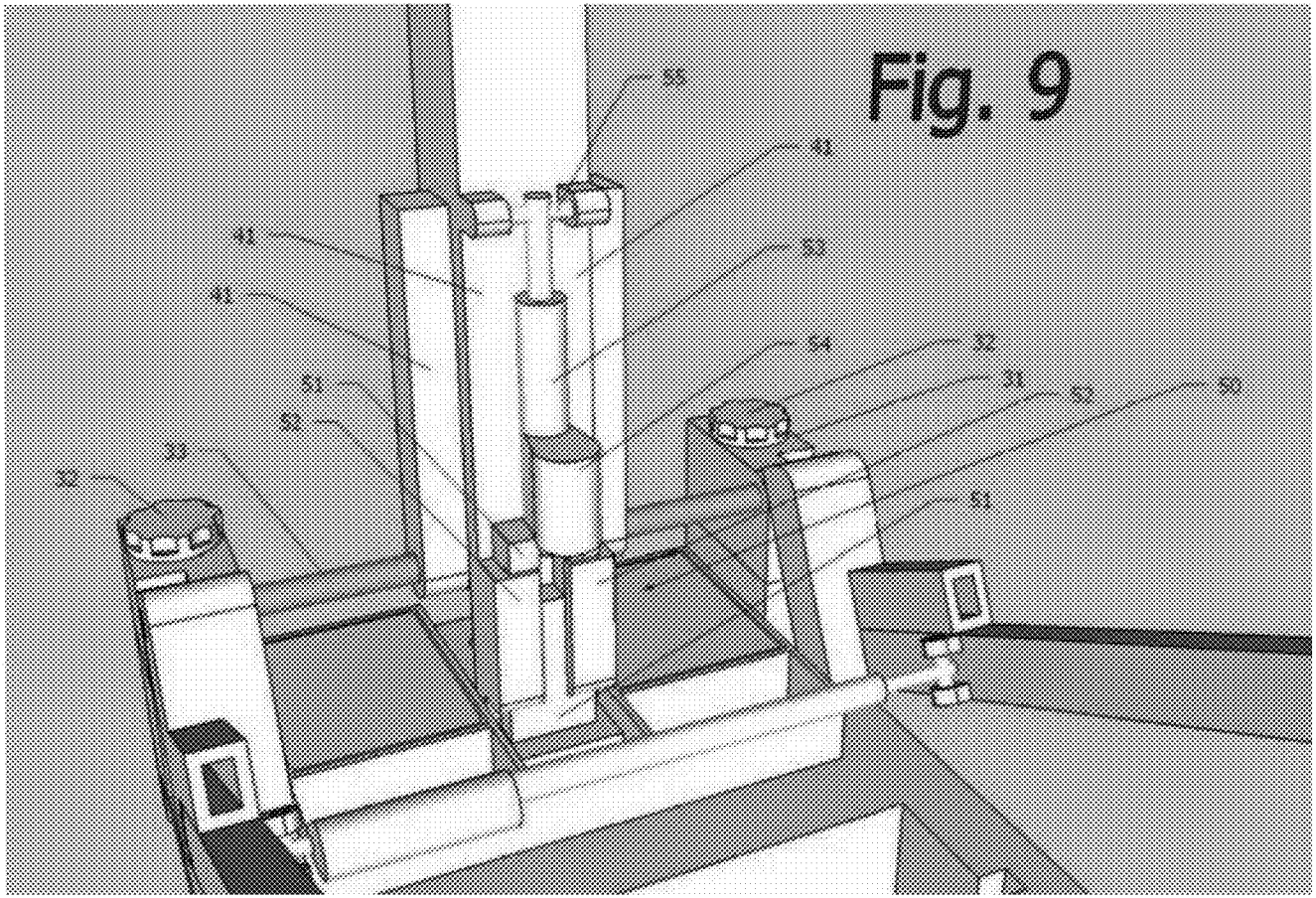
FIG. 9 depicts an upper perspective detail view of one embodiment of the Lift Arm Locking Bolt Assembly (50) with the Lift Arm Locking Bolt (51) in the down/locked position.

In some embodiments, movement of the Lift Arm (41) is either prevented or allowed by the Lift Arm Locking Bolt Assembly (50). In the embodiments shown in FIGS. 8 and 9, the Lift Arm Locking Bolt Assembly (50) is comprised of the Lift Arm Locking Bolt (51) which slides up and down through the Locking Bolt Slide (52) which is solidly attached to and near the lower end of the Lift Arm (41) such that when the Lift Arm Locking Bolt (51) is in the down/locked position, the Lift Arm Locking Bolt (51) extends downward through the Lock Bolt Receiver (24) of the Trailing Cart (20). In some embodiments, connected between the Locking Bolt Actuator Connector (55) at its upper end and the Lift Arm Locking Bolt (51) at its lower end is the Locking Bolt Actuator (53), a common mechanical device capable of providing both a downward pushing force and an upward pulling force such that the user can easily engage and disengage the Lift Arm Locking Bolt (51) as needed. When the Lift Arm (41) is secured in the vertical position via the Lift Arm Locking Bolt (51) being in the down/locked position and extending into the Lock Bolt receiver (25) as seen in FIG. 9, any force created by the Main Linear Actuator (47) is transferred to the Outriggers (36). In this manner the Outrigger Extensions (37) can be either raised or lowered by the user either extending or contracting the Main Linear Actuator (47) while the Lift Arm Locking Bolt (51) is in the down/locked position. When the Outriggers (36) and the Outrigger Extensions (37) are in position to accept and transfer the user's weight to a suitable weight bearing surface such as a floor or bed or other seating surface, the user can simply raise the Lift Arm Locking Bolt (51) to the up/unlocked position as seen in FIG. 8, thus freeing the Lift Arm (41) to pivot about the horizontally secured Outrigger Fulcrum Bar (33) either forward away from the user to lift the user into the standing position or rearward toward the user to gently lower the user to the seated position. Both procedures are accomplished without requiring the user to provide any leg strength whatsoever but rather by the user simply extending or contracting the Main Linear Actuator (47).

The Lift Arm Locking Bolt Assembly (50) may vary significantly in design and structure. The Lift Arm Locking Bolt Assembly (50) is generally responsible for allowing the user to lock the Lift Arm (41) in the upright vertical position and then unlock the Lift Arm (41) to allow the Lift Arm (41) to perform the function of lifting the user by transferring the user's weight through the Lift Arm Assembly (40) to the Outrigger Assembly (20) and then to a weight bearing surface such as a floor, bed, or other seating surface. Also, the Lift Arm Locking Bolt Assembly (50) must be sufficiently strong to help stabilize the user while riding on the Device (1) by stabilizing the Lift Arm Assembly (40) in connection to the Trailing Cart (20) as the Outrigger Assembly (30) will no longer be supporting any of the user's weight. The Locking Bolt Actuator (53) could possibly be replaced with any mechanical device capable of engaging and disengaging the Lift Arm Locking Bolt (51) such as a hydraulic or pneumatic cylinder, or by a combination of such and other mechanisms arranged to provide the user control over the position of the Lift Arm Locking Bolt (51).

Knee Brace Assembly

As seen in FIG. 10 of the drawings, the Knee Brace Assembly (60) is generally comprised of the Knee Brace (61) and other components designed to secure the Knee Brace (61) to the Trailing Cart (20), such as to generally enhance the user's comfort while using the Device (1). The Knee Brace (61) is a generally vertical structure designed to provide a structurally sound surface against which the user might position his or her knees during the seated-to-standing procedure, during the standing-to-seated procedure, when the user is riding on the Device (1), etc. The Knee Brace (61) of some embodiments is equipped with a Knee Padding (62) to enhance user comfort, and a Knee Brace Support (63) to support the Knee Brace (61) when it's attached to the Trailing Cart (20) via the Knee Brace Support (63) being inserted into the Knee Brace Receiver (28) on the Trailing Cart (20) and secured in place via the Knee Brace Fastener (64) being inserted and then tightened into the Knee Brace Fastener Receiver (29) on the Trailing Cart (20). It should be noted that for visual clarity FIG. 10 shows only one of two Knee Braces (61) which may be used with the Device (1) of this embodiment at any given time, specifically the right Knee Brace (61). The left portion of the Knee Brace Assembly (60) would be a mirror image, otherwise identical to the right portion. Illustrations of both Knee Braces (61) in place can be seen in FIGS. 11, 12, 13, 16(A), 16(B), and 16(C). The Knee Brace Assembly (60) of some embodiments may be designed as two separate groups (i.e. right side and left side) rather than as a single component (where the user could position both knees) so that the Lift Arm (41) can traverse a greater range of motion by passing between the Knee Braces (61) during the seated-to-standing procedure, during the standing-to-seated procedure, etc.

The Knee Brace Assembly (60) may vary significantly in design, composition, material, structure, etc. in order to accommodate a number of variables, including but not limited to users of various size and weight, users with varying degrees of impairment involving the hips and/or legs such as structural, mobility, or strength issues resulting from injury, illness, or defect, etc. As shown in the embodiment of FIG. 17, an example of one such variation is a Specialized Leg Support (65) and Specialized Leg Support Padding (66) designed to support the weight of a user who is missing the lower portion of his or her right leg. Due to the broad range of physical impairments that prevent people from standing, sitting, or walking unassisted, an equally broad range of structural and functional variations of the Knee Brace Assembly (60) will be necessary in order to address these physical impairments for the benefit of individuals across the entire spectrum of disabilities.

Control Assembly

Figure 11:
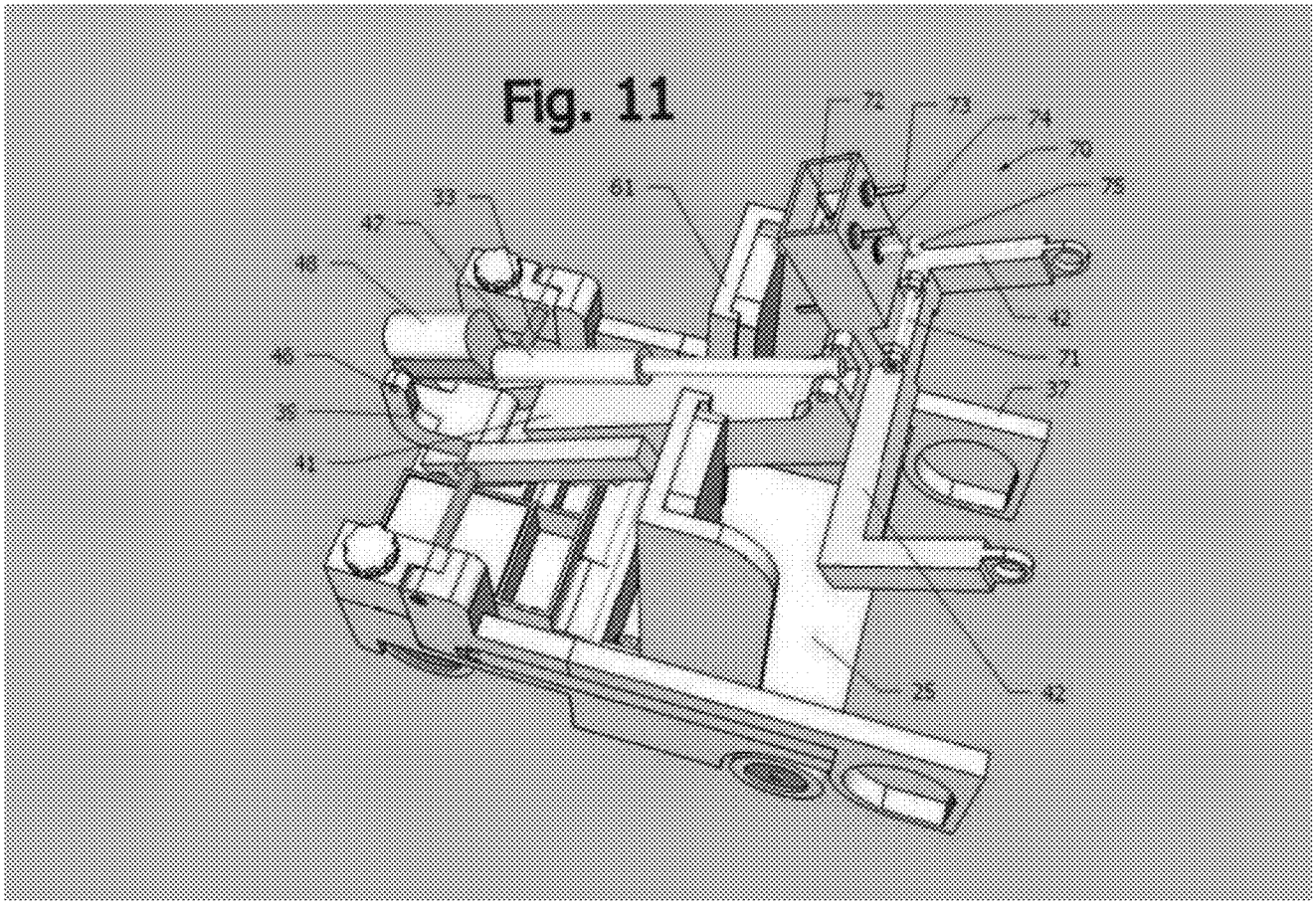
FIG. 11 depicts an upper perspective view of one embodiment of the Control Assembly (70) in the raised position. For visual clarity, the Lift Arm (41) is shown in the partially lowered position, both Knee Braces (61) are shown installed, and the Outrigger Extensions (37) are shown in the fully lowered and stowed position.
Figure 12:
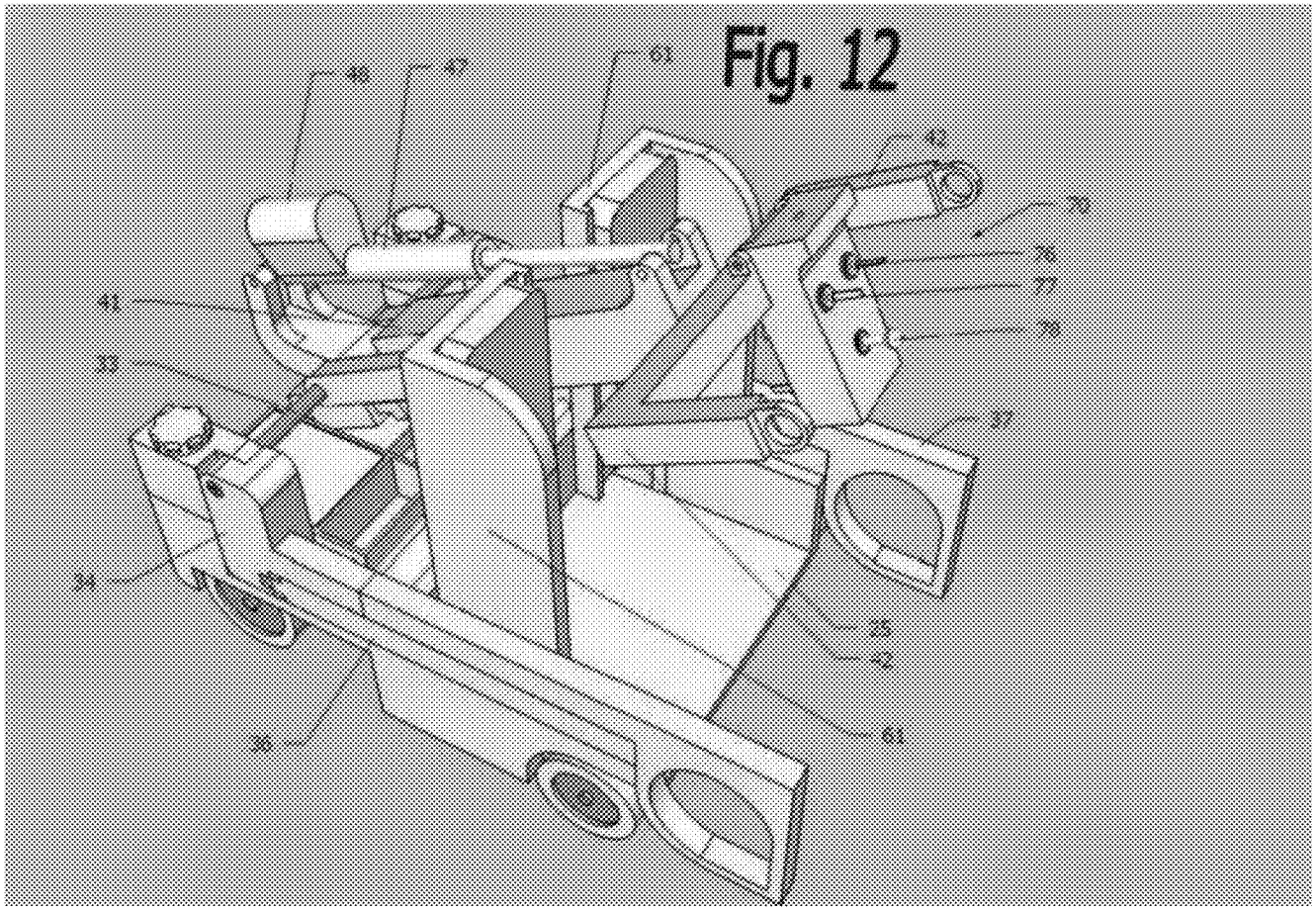
FIG. 12 depicts an upper perspective view of one embodiment of the Control Assembly (70) in the lowered position. For visual clarity, the Lift Arm (41) is shown in the partially lowered position, both Knee Braces (61) are shown installed, and the Outrigger Extensions (37) are shown in the fully lowered and stowed position.

As seen in FIGS. 11 and 12 of the drawings, the Control Assembly (70) is comprised of a Control Body (71) attached to the Lift Arm Assembly (40) at the Control Panel Connection (49) near the top of the Lift Arm Extension (42). In some embodiments the control assembly is moveable, rotatable, a remote control, etc. The Control Assembly (70) may include, but is not limited to controls for the Motorized Drive Wheels (13), the Outrigger Spreader Actuator (38), the Main Linear Actuator (47), and the Lift Arm Locking Bolt (51). In some embodiments of the Device (1), the Control Body (71) may be attached in such a way as to allow for the rotation of the Control Body (71) between a fully forward position away from the user and a fully rearward position toward the user in order to improve user comfort. In such an arrangement it may be necessary to have duplicate controls on both of the Control Body (71) surfaces that will face upward when the Control Assembly (70) is in either the forward or rearward position. In the embodiment as shown in FIG. 11, when the Control Body (71) is in the fully forward position, the user will be able to control the Main Linear Actuator (47) via the First Main Actuator In/Out Switch (73), the Outrigger Spreader Actuator (38) via the First Spreader Actuator In/Out Switch (74), the Motorized Drive Wheels (13) via the First Drive Wheels Joystick Control (75) which is capable of controlling the speed and direction of the Device (1) by controlling the speed of each of the Motorized Drive Wheels (13) on the Drive Carriage (10) individually, and the Lift Arm Locking Bolt (51) via the Lift Arm Locking Bolt Switch (72). As shown in FIG. 12, when the Control Body (71) of some embodiments is in the fully rearward position, the user will be able to control the Main Linear Actuator (47) via the Second Main Actuator In/Out Switch (76), the Outrigger Spreader Actuator (38) via the Second Spreader Actuator In/Out Switch (77), the Motorized Drive Wheels (13) via the Second Drive Wheels Joystick Control (75) which is capable of controlling the speed and direction of the Device (1) by controlling the speed of each of the Motorized Drive Wheels (13) on the Drive Carriage (10) individually, and the Lift Arm Locking Bolt (51) via the Lift Arm Locking Bolt Switch (72) although not shown in FIG. 12.

Structural and functional variations of the Control Body Assembly (70) are anticipated and include but are not limited to such variations as wired rather than wireless controls, separate In and Out buttons rather than 2-way toggle switches, trackball controls rather than joystick controls for speed and direction control, and computer controls of various types with varying user interface options such as touch screen, tap, sip-and-puff, or voice controls. The size and shape of the Control Assembly (70) may vary greatly dependent upon the physical dimensions of the contained controls, and the location of the Control Assembly (70) on the Device (1) as well as its means of attachment to the Device (1) may vary greatly dependent upon the physical size and abilities or disabilities of the individual user. Any combination or configuration of controls designed to enable the user to manipulate the elements of the present invention or any variation of the present invention would fall within the scope of the present invention.

User Connection Group

The User Connection Group (80) of some embodiments is comprised of various components capable of enabling the user to comfortably connect himself/herself to the Device (1) such that the user might be able to utilize and benefit from the Device (1). One such component is an Adjustable Belt (81) with two Strap-to-Belt Connectors (82) one each positioned at opposite sides such that one is generally above each of the user's hips. Each Strap-to-Belt Connector (82) would be connected to a flexible Strap (83) made of a suitable material for example, cloth, leather, synthetic fiber, etc. with sufficient strength to adequately support the user's weight during the standing-to-seated procedure and during the seated-to-standing procedure. Other embodiments may include any number of Strap-to-Belt Connectors (82) in any number of positions. Each Strap (83) may then be connected to the Lift Arm Extension (42) via a Strap-to-Lift Arm Extension Connector (84) engaging the corresponding Strap Receiver (44) of the Lift Arm Extension (42). Once the user is securely attached to the Device (1), the Outrigger Extensions (37) are in contact with a suitable weight bearing surface such as a floor, bed, or chair, and the Lift Arm Locking Bolt (51) is in the up/unlocked position as illustrated in FIG. 8 of the drawings, the user's position can be changed from standing to seated by extending the Main Linear Actuator (47) or from seated to standing by contracting the Main Linear Actuator (47).

As with the Lift Arm Extension (42), the User Connection Group may vary in design, composition, material, structure, etc. in order to accept and accommodate various individual users with a diverse range of physical needs and limitations. Rather than an Adjustable Belt (81), an individual user may require a sling positioned below each arm and encircling the body at the chest and back, or a harness secured to support the entire torso. Users lacking sufficient strength to stabilize their upper body may require structurally rigid members in place of the flexible fabric or leather Straps (83) such that the Device (1) might provide additional upper body support and stability. Any combination or configuration of components designed to enable the user to be connected in any way to the Device (1) or any variation of the Device (1) would fall within the scope of the present disclosure.

Connections of Main Elements and Sub-Elements

In some embodiments, the Drive Carriage Assembly (10) is connected to the Trailing Cart Assembly (20) via the Connecting Pin (12) being engaged by the Connecting Bearing (21) such that the Drive Carriage Assembly (10) can rotate from side to side around the Connecting Pin (12) as a vertical axis. The Motorized Wheels (13) may be connected to the Body (11) of the Drive Carriage Assembly (10) via threaded fasteners for example, common bolts, screws, etc. The Steering Limiter (14) may be solidly connected to the Body (11) of the Drive Carriage Assembly (10) via, for example, welding or other permanent bond type of attachment.

In some embodiments, the Connecting Bearing (21) is solidly connected to the Trailing Cart Assembly (20) via, for example, welding or other permanent bond type of attachment. The Steering Stop (22) may be solidly connected to the Trailing Cart Assembly (20) via, for example, welding or other permanent bond type of attachment. In some embodiments, the Support Block Receivers (23) are integral to the shape of the Trailing Cart Assembly (20), as are the Lock Bolt Receiver (24), the Standing Platform (25), the dividers forming the spaces where the Batteries (27) are kept, and the Knee Brace Receivers (28). The Knee Brace Fastener Receivers (29) may be threaded holes in the Trailing Cart Assembly (20). Each Trailing Wheel (26) may have bearings that allow the Trailing Wheel (26) to rotate around an axle, which may be secured to an attachment plate by welding, and the attachment plate may be attached to the Trailing Cart Assembly (20) via threaded fasteners, for example, common bolts, screws, etc.

In some embodiments, the Outrigger Assembly (30) is connected to the Trailing Cart Assembly (20) via two Support Blocks (31) which are capable of structurally engaging the Support Block Receivers (23) where each is held in place and secured by one of a set of threaded Support Block Fasteners (32), for example 2 threaded Support Block Fasteners (32) each of which extends downward through the Support Block (31) to engage a threaded hole in the base of the Support Block Receiver (23). The upper end of each Support Block Fastener (32) may extend and remain beyond the uppermost surface of the Support Block (31) to facilitate removal of the Outrigger Assembly (30) from the Trailing Cart Assembly (20) should such disassembly be sought. The Outrigger Fulcrum Bar (33) may be pivotably attached to each of the two Support Blocks (31) by physically extending through a set of bearings in each Support Block (31), such that the Outrigger Fulcrum Bar (33) is secured in a horizontal position yet free to rotate within the bearings of each parallel Support Block (31). The Outrigger Blocks (34) may be solidly connected to the Outrigger Fulcrum Bar (33) via, for example, welding or other permanent bond type of attachment. Each Outrigger (36) may be connected to the corresponding Outrigger Block (34) by an Outrigger Lateral Hinge (35). Each Outrigger Lateral Hinge (35) may be formed by the interconnecting shapes of the Outrigger Block (34) and the forward end of the corresponding Outrigger (36) being attached via a hinge pin. The Outrigger Extensions (37) are attached to the Outriggers (36) via a larger end of the Outrigger (36) as seen in FIG. 10, which is capable of accepting and supporting a smaller end on the Outrigger Extension (37) as seen in FIG. 15 of the drawings. The Outrigger Spreader Actuator (38) may be pivotably connected at one end to one of the two Outriggers (36) via a pin and pivotably connected at the other end to the other of the two Outriggers (36) also via a pin thus allowing the angle of connection between each end of the Outrigger Spreader (38) and its connected Outrigger (36) to change independently as the Outrigger Spreader (38) pushes the Outriggers (36) in opposite directions away from opposite sides of the Trailing Cart Assembly (20). The Outrigger Lever (39) may be solidly connected to the Outrigger Fulcrum Bar (33) via, for example, welding or other permanent bond type of attachment.

In some embodiments, as seen in FIGS. 6-9 of the drawings, the Lift Arm Assembly (40) is pivotably connected to the Outrigger Assembly (30) via the Outrigger Fulcrum Bar (33) which physically extends through two sets of bearings, one in each of two opposing sides of the lower end of the Lift Arm (41), each of which opposing side is positioned on opposite sides of the Outrigger Lever (39), such that the Lift Arm Assembly (40) is secured in a position perpendicular to the Outrigger Fulcrum Bar (33) yet free to rotate about the Outrigger Fulcrum Bar (33) in a generally vertical direction. In some embodiments, the Lift Arm Extension (42) is connected to the Lift Arm (41) via its lower end sliding into a receiving portion at the upper end of the Lift Arm (41) which is designed such that its inner dimensions are equal to and the same shape as the outer dimensions of the lower end of the Lift Arm Extension (42) and either held securely in place by tightening the Lift Arm Adjustment Fastener (43) or allowed to slide by loosening the Lift Arm Adjustment Fastener (43). The Strap Receivers (44) are connected to the outward ends of the Lift Arm Extension (42) via, for example, welding or other permanent bond type of attachment. The Main Linear Actuator (47) may be pivotably connected at its upper end to the Lift Arm (41) via a pin at the Main Actuator Pivot (45) and pivotably connected at its lower end to the Outrigger Lever (39) also via a pin such that the angle of connection between the Main Linear Actuator (47) and the Lift Arm (41) and also the angle of connection between the Main Linear Actuator (47) and the Outrigger Lever (39) are free to change independently as the Main Linear Actuator (47) is extended or contracted in length. The Main Actuator Motor (48) may be solidly attached to the Main Linear Actuator (47) generally via welding for example; as such motor-driven linear actuator devices are typically manufactured and made available as a single unit. The Control Panel Connection (49) may be solidly connected to the Lift Arm Extension (42) via, for example, welding or other permanent bond type of attachment.

In some embodiments, as seen in FIGS. 8 and 9 of the drawings, the Lift Arm Locking Bolt Assembly (50) is comprised of the Locking Bolt Slide (52) which is solidly connected to the Lift Arm (41) via, for example, welding or other permanent bond type of attachment, which secures and through which slides the Lift Arm Locking Bolt (51). The range of motion available to the Lift Arm Locking Bolt (51) is determined by, and the force required to slide the Lift Arm Locking Bolt (51) is provided by the Locking Bolt Actuator (53) which is connected at its upper end to the Lift Arm (41) via a pin at the Locking Bolt Actuator Connector (55) and at its lower end to the Lift Arm Locking Bolt (51) via a pin. The Locking Bolt Actuator Motor (54) is solidly attached to the Locking Bolt Actuator (53) generally via, for example, welding or other permanent bond type of attachment; as such motor-driven linear actuator devices are typically manufactured and made available as a single unit.

Figures 13A, 13B:
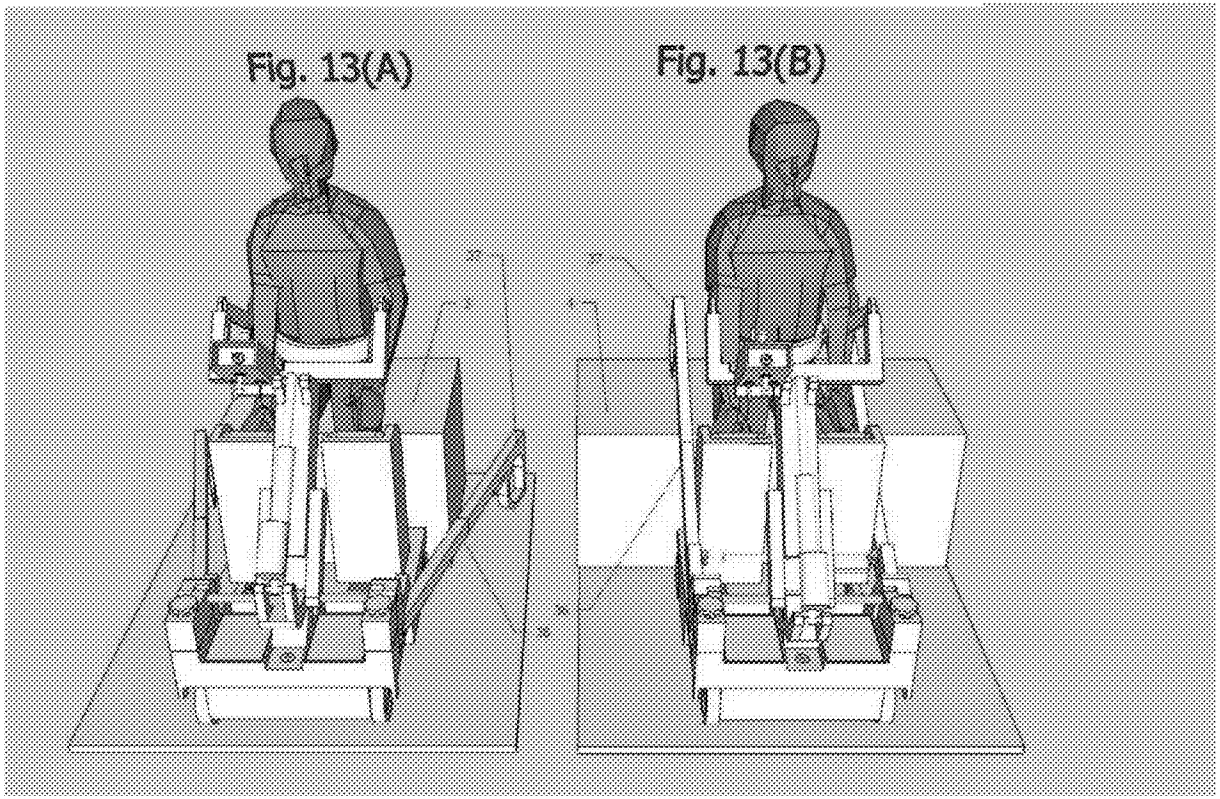
FIG. 13(A) depicts an upper perspective view of one embodiment of the device with Outriggers (36) laterally expanded such that the Outrigger Extensions (37) can be lowered to contact the floor on either side of the seat (3).
FIG. 13(B) depicts an upper perspective view of one embodiment of the device with Outriggers (36) laterally retracted such that the Outrigger Extensions (37) can be lowered to contact the surface of the seat (4).

In some embodiments, as shown in FIGS. 11-13 of the drawings, the Knee Brace Assembly (60) consists of two generally substantially vertical Knee Braces (61) with Knee Padding (62). The Knee Padding (62) can be connected to the Knee Brace (61) by any number of fasteners, for example by adhesive, by straps, by hook-and-eye, etc. so long as the connection is adequate to maintain the padding's position within the brace. As shown in FIG. 10, each Knee Brace (61) is connected to the Trailing Cart Assembly (20) via the Knee Brace Support (63), which is connected to the Knee Brace (61) via, for example, welding or other permanent bond type of attachment. The Knee Brace Support (63) is inserted into the Knee Brace Receiver (28). The Knee Brace (61) is then secured in position by the Knee Brace Fastener (64) being inserted into the Knee Brace Fastener Receiver (29) and then tightened.

In the some embodiments, the Control Assembly (70) is connected to the Lift Arm Extension (42) at the Control Panel Connection (49) via a pin such that the Control Body (71) will be free to pivot in order to maximize user comfort. All of the switches and controls may be connected to the Control Body (71) via treaded rings capable of supporting and securing such switches and controls in position. The electrical cabling for joining the various electrical components has been omitted in the drawings, as such cabling is conventional and will be positioned so as to extend through or along the various frame and structural components so as to join the controller and the various motors to the Control Assembly (70) and Batteries (27).

In some embodiments, the Straps (83) are connected at one end to the Lift Arm Extension (42) at the Strap Receivers (44) via the Strap-to-Lift Arm Extension Connectors (84) which are easily removable hooks which are self-closing by virtue of an inherent spring device, and at the other end to the Strap-to-Belt Connectors (82) via reinforced stitching and/or riveting. The Strap-to-Belt Connectors (82) may also be connected to the Adjustable Belt (81) via reinforced stitching and/or riveting.

Alternative Embodiments

An alternative embodiment is a User-Propelled Sit-To-Stand Device (100) as illustrated in FIG. 18 of the drawings, which generally includes the components required to provide the sit-to-stand and stand-to-sit assist functions exactly as does the Device (1) illustrated in FIGS. 1-16 of the drawings, but without the motorized transportation features of the Device (1), such that the user would be raised to a standing position on the floor rather than on the Standing Platform (25) and physically push, pull and/or steer the device to move from location to location rather than using either the First Drive Wheels Joystick Control (75) or the Second Drive Wheels Joystick Control (78) to activate the Motorized Drive Wheels (13) to pull, push, and/or steer the device. Such a User-Propelled Sit-To-Stand Device (100) would allow users who are able to walk when using something to maintain balance (such as a walker) but lack the physical strength to stand unassisted from a bed, chair, or commode, to maintain a fairly independent lifestyle. Typically, such individuals must surrender their independence and move into an assisted living facility or move in with a family member if such an arrangement is an option. Such a User-Propelled Sit-To-Stand Device (100) could also benefit users involved in either short or long term rehabilitation following any type of surgery, injury, or illness which would make it difficult or impossible for the user to stand unassisted from a bed, chair, or commode. Such a User-Propelled Sit-To-Stand Device (100) would play a significant role in the ongoing efforts to reduce and eventually eliminate injuries to caregivers tasked with assisting disabled patients from seated to standing or from standing to seated. Such a User-Propelled Sit-To-Stand Device (100) would be significantly more affordable than the motor-driven Device (1) illustrated in FIGS. 1-17 of the drawings, and entirely suitable for indoor use either in the patient's home or a health-care facility such as a hospital, nursing home, or rehab facility.

Operation of the Embodiments

Some embodiments are capable of performing the following three distinct functions: Seated-to-Standing Assistance, User-Controlled Mobility Assistance, and Standing-to-Seated Assistance. Operation for each function is described as follows.

Seated-to-Standing Assistance

In some embodiments, to begin the seated-to-standing procedure, the user would don the Adjustable Belt (81) about the waist such that each of the two Strap-to-Belt Connectors (82) was positioned generally above one hip and adjust the Adjustable Belt (81) for comfort, understanding that it will be the Adjustable Belt (81) that will support their body weight as the Device (1) raises them to a standing position.

With the user in the seated position with his or her body weight resting on a typical bed, chair, commode, or other similar seating surface, and the Lift Arm Locking Bolt (51) of the Device (1) in the down/locked position securing the Lift Arm (41) in the fully upright position as shown in FIG. 9 of the drawings, and the Control Body (71) positioned for maximum user convenience and comfort either extended forward away from the user as shown in FIG. 11, or extending backward toward the user as shown in FIG. 12, the Device (1) is situated such that the user is facing the Device (1) with feet resting on the Standing Platform (25) and knees positioned against the Knee Padding (62) of the Knee Braces (61).

Depending upon the selected position of the Control Body (71) the user would use either the First Main Actuator In/Out Switch (73) as shown in FIG. 11 of the drawings or the Second Main Actuator In/Out Switch (76) as shown in FIG. 12, to activate the Main Actuator Motor (48) causing the Main Linear Actuator (47) to either extend or contract.

In the described configuration, with the Lift Arm Locking Bolt (51) in the down/locked position, any extension of the Main Linear Actuator (47) will result in a downward force applied to the Outrigger Lever (39), causing the attached Outrigger Fulcrum Bar (33) to pivot within the Support Blocks (31) and thus the Outrigger Blocks (34) which are also attached to the Outrigger Fulcrum Bar (33) to pivot resulting in an upward force being applied to the attached Outriggers (36) and thus to the attached Outrigger Extensions (37).

Conversely, with the Lift Arm Locking Bolt (51) in the down/locked position, any contraction of the Main Linear Actuator (47) will result in an upward force applied to the Outrigger Lever (39), causing the attached Outrigger Fulcrum Bar (33) to pivot within the Support Blocks (31) and thus the Outrigger Blocks (34) which are also attached to the Outrigger Fulcrum Bar (33) to pivot resulting in a downward force being applied to the attached Outriggers (36) and thus to the attached Outrigger Extensions (37).

Further, and also depending upon the selected position of the Control Body (71) the user may also use either the First Outrigger Spreader In/Out Switch (74) as shown in FIG. 11 of the drawings or the Second Outrigger Spreader In/Out Switch (77) as shown in FIG. 12 to cause the Outrigger Spreader Actuator (38) to either extend or contract. Because each end of the Outrigger Spreader Actuator (38) is pivotably connected to one of the two Outriggers (36) while the forward end of each Outrigger (36) is connected to one of the two Outrigger Blocks (34) via an Outrigger Lateral Hinge (35), any expansion of the Outrigger Spreader Actuator (38) will result in an outward force causing the distance between the rearward ends of the two Outriggers (36) to be increased, and thus the distance between the two Outrigger Extensions (37) to also be increased as seen in FIG. 13 of the drawings. Conversely, any contraction of the Outrigger Spreader Actuator (38) will result in an inward force causing the distance between the rearward ends of the two Outriggers (36) to be decreased, and thus the distance between the two Outrigger Extensions (37) to also be decreased. This ability for the user to easily either increase or decrease the distance between the Outrigger Extensions (37) allows the user to have even greater control over the positioning of the Outrigger Extensions (37) in order to accommodate a wide variety of seating surfaces, furniture types, dimensions, and available space considerations.

Using the various controls in this manner, the user is able to manipulate and control the upward, downward, and lateral movement of the Outriggers (36) until the Outrigger Extensions (37) are in contact with an existing weight bearing surface such as the floor or in some cases the seating surface itself, such as a bed or chair or sofa. An example is illustrated in FIG. 14 of the drawings.

Once the user has positioned the Outriggers (36) such that the Outrigger Extensions (37) are solidly in contact with a suitable weight bearing surface, the user will then use the Lift Arm Locking Bolt Switch (72) as shown in FIG. 11 of the drawings to activate the Locking Bolt Actuator Motor (54) to cause the Locking Bolt Actuator (53) to contract, thus applying an upward force to the Lift Arm Locking Bolt (51) and causing the Lift Arm Locking Bolt (51) to slide upward through the Locking Bolt Slide (52) until the Lift Arm Locking Bolt (51) is fully disengaged from the Lock Bolt Receiver (24) as illustrated in FIG. 8 of the drawings, at which point the Lift Arm (41) will no longer be secured in the fully upright and vertical position.

As the Lift Arm (41) is now free to move, its lower end will rotate around the Outrigger Fulcrum Bar (33) causing its upper end to move closer to or further away from the user, who is able to easily control such movement using either the First Main Actuator In/Out Switch (73) as shown in FIG. 11 of the drawings or the Second Main Actuator In/Out Switch (76) as shown in FIG. 12 of the drawings to activate the Main Actuator Motor (48) causing the Main Linear Actuator (47) to either extend or contract.

In this configuration, with the Lift Arm Locking Bolt (51) in the up/unlocked position and the Lift Arm (41) free to move, any extension of the Main Linear Actuator (47) will cause the attached Lift Arm (41) to move closer to the user. Conversely, any contraction of the Main Linear Actuator (47) will cause the attached Lift Arm (41) to move away from the user. As the user manipulates the Lift Arm Extension (42) into position near his or her waist, the Lift Arm Extension (42) can also be adjusted inward away from the user or outward toward the user by loosening the Lift Arm Adjustment Fastener (43), sliding the Lift Arm Extension (42) further into or out from the Lift Arm (41), and then tightening the Lift Arm Extension Fastener (43) such as to secure the Lift Arm Extension (42) in place.

Figure 1:
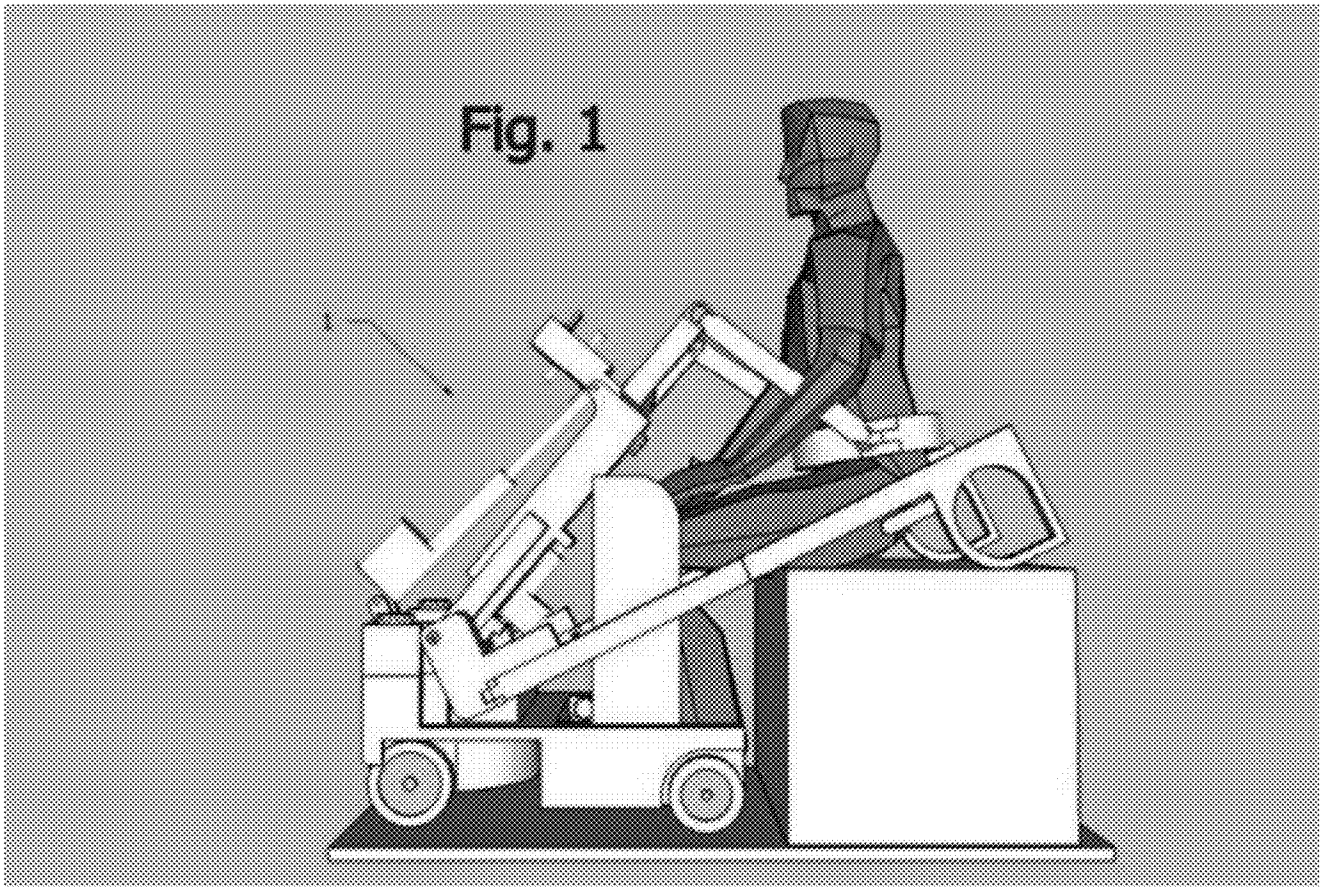
FIG. 1 depicts a left side view of one embodiment showing the device (1) as it would appear during one of the early steps of a typical seated-to-standing assist procedure.

Once the Lift Arm Extension (42) has been positioned such that the Strap Receivers (44) are sufficiently near the Straps (83), which are attached to the Adjustable Belt (81) worn by the user, the Straps (83) are then connected to the Strap Receivers (44) via the Strap-to-Arm Extension Connectors (84). At this time the user is connected to the Device (1) and the Outrigger Extensions (37) are positioned to transfer weight to some existing weight bearing surface as is illustrated in FIGS. 1, 13, and 16 of the drawings.

Once connected to the Device (1) the user would manipulate either the First Main Actuator In/Out Switch (73) as shown in FIG. 11 of the drawings or the Second Main Actuator In/Out Switch (76) as shown in FIG. 12 of the drawings to activate the Main Actuator Motor (48) causing the Main Linear Actuator (47) to contract, thus causing the Lift Arm (41) and thus the attached Lift Arm Extension (42) and the attached components of the User Connection Group (80) which are being used to attach the user to the Device (1) to move upward and forward away from the seating surface. By the user bracing his or her knees against the Knee Padding (62) of the Knee Braces (61), the knees will remain generally above the user's feet, and by bringing the user's waist and hips upward and forward into a position generally above the user's knees, the user is raised into a standing position on the Standing Platform (25) as illustrated in FIG. 16(B) of the drawings.

During the seated-to-standing procedure, any weight applied to the Lift Arm (41) including the weight of the Lift Arm Assembly (40), the Lift Arm Locking Bolt Assembly (50), the Control Assembly (70), and eventually the User Connection Group (80) and the user's body weight will be transferred through the Lift Arm Assembly (40) and the Outrigger Assembly (30) to the selected weight bearing surface.

Once the user is in the standing position, he or she would use the Lift Arm Locking Bolt Switch (72) to activate the Locking Bolt Actuator Motor (54) to extend the Locking Bolt Actuator (53) causing a downward force such that the Lift Arm Locking Bolt (51) is pushed downward through the Locking Bolt Slide (52) until it is fully engaged in the Lock Bolt Receiver (24) and thereby the Lift Arm (41) is once again locked and secured in the fully upright and vertical position.

Figures 16A, 16B, 16C:
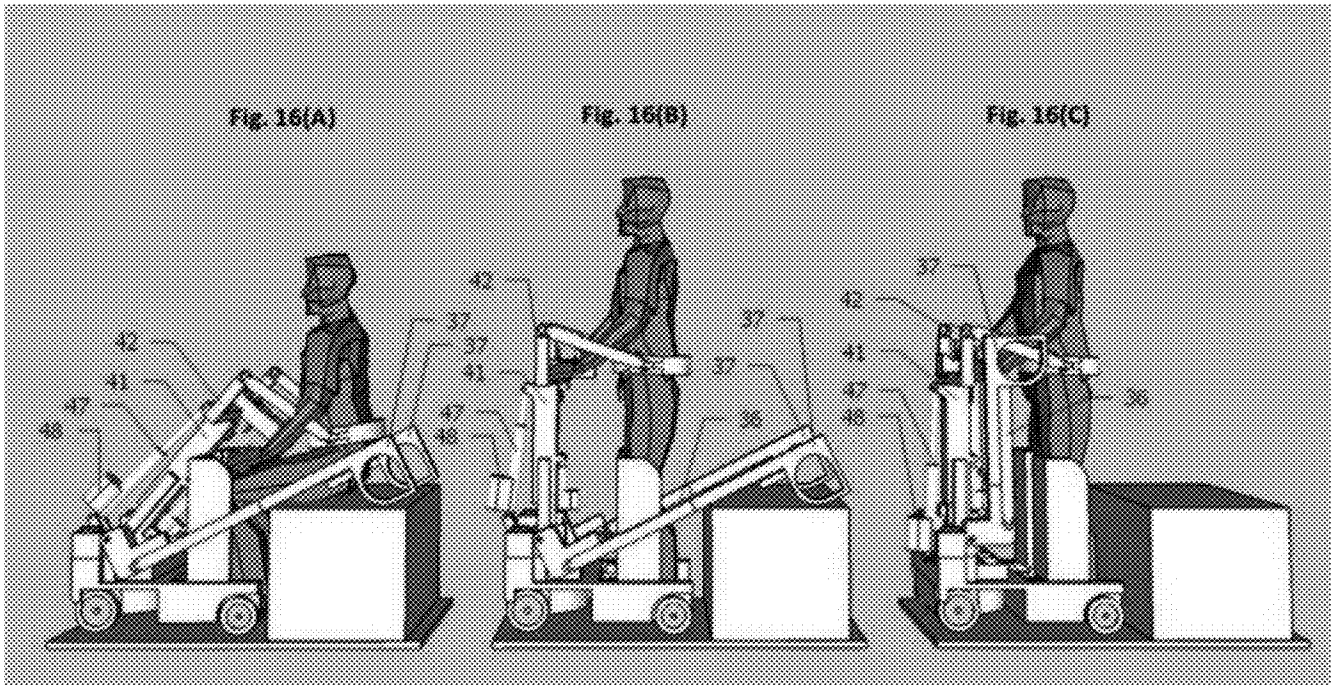
FIG. 16 (A) depicts a side view of one embodiment illustrating the user in a seated position at the beginning of the standing process with the Outrigger Extensions (37) lowered as to contact the seating surface.

At this time the user would manipulate either the First Main Actuator In/Out Switch (73) as shown in FIG. 11 of the drawings or the Second Main Actuator In/Out Switch (76) as shown in FIG. 12 of the drawings to activate the Main Actuator Motor (48) causing the Main Linear Actuator (47) to extend, resulting in a downward force applied to the Outrigger Lever (39), causing the attached Outrigger Fulcrum Bar (33) to pivot within the Support Blocks (31) and thus the Outrigger Blocks (34) which are also attached to the Outrigger Fulcrum Bar (33) to pivot resulting in an upward force being applied to the attached Outriggers (36) and thus to the attached Outrigger Extensions (37) causing the Outriggers (36) to rotate upward and thus the Outrigger Extensions (37) to be raised from their position of contact with the selected weight bearing surface to a generally upright position as shown in FIG. 16(C) of the drawings.

User-Controlled Mobility Assistance

With the Lift Arm (41) locked in the fully upright position, the Outriggers (36) raised, and the user connected to the Device (1), the user may then proceed to drive the Device (1) using either of the two joysticks (75 or 78) to control the speed and direction of the Device (1) by controlling the speed of each individual Motorized Drive Wheel (13) as is the method by which a user would typically control the speed and direction of a motorized wheelchair.

Standing-to-Seated Assistance

The standing-to-seated procedure is essentially the opposite of the seated-to-standing procedure, in that the procedure would begin with the Lift Arm (41) locked in the fully upright position, with the Outriggers (36) in a generally upright position and with the user standing on the Standing Platform (25) and connected to the Device (1) via Straps (83) connected at one end to the Strap Receivers (44) on the Lift Arm Extension (42) and at the other end to the Strap-to-Belt Connectors (82) on the Adjustable Belt (81) worn by the user.

The user would then, using either of the two joysticks (75 or 78) to control the speed and direction of the Device (1), position the Device (1) such that the user would be near enough and in the proper position in relation to a desired seating surface to allow the Device (1) to assist the user from the present standing position to a seated position upon the desired seating surface.

Once the Device (1) has been so positioned, the user would then manipulate either the First Main Actuator In/Out Switch (73) as shown in FIG. 11 of the drawings or the Second Main Actuator In/Out Switch (76) as shown in FIG. 12 of the drawings to activate the Main Actuator Motor (48) causing the Main Linear Actuator (47) to contract, resulting in an upward force applied to the Outrigger Lever (39), causing the attached Outrigger Fulcrum Bar (33) to pivot within the Support Blocks (31) and thus the Outrigger Blocks (34) which are also attached to the Outrigger Fulcrum Bar (33) to pivot resulting in a downward force being applied to the attached Outriggers (36) and thus to the attached Outrigger Extensions (37) causing the Outriggers (36) to rotate downward and thus the Outrigger Extensions (37) to be lowered into a position of contact with a suitable weight bearing surface for example, a floor, bed, chair, etc.

Further, the user may also use either the First Outrigger Spreader In/Out Switch (74) as shown in FIG. 11 of the drawings or the Second Outrigger Spreader In/Out Switch (77) as shown in FIG. 12 of the drawings to cause the Outrigger Spreader Actuator (38) to either extend or contract. Because each end of the Outrigger Spreader Actuator (38) is pivotably connected one of the two Outriggers (36) while the forward end of each Outrigger (36) is connected to one of the two Outrigger Blocks (34) via an Outrigger Lateral Hinge (35), any expansion of the Outrigger Spreader Actuator (38) will result in an outward force causing the distance between the rearward ends of the two Outriggers (36) to be increased, and thus the distance between the two Outrigger Extensions (37) to also be increased as seen in FIG. 13 of the drawings. Conversely, any contraction of the Outrigger Spreader Actuator (38) will result in an inward force causing the distance between the rearward ends of the two Outriggers (36) to be decreased, and thus the distance between the two Outrigger Extensions (37) to also be decreased. This ability for the user to easily either increase or decrease the distance between the Outrigger Extensions (37) allows the user to have even greater control over the positioning of the Outrigger Extensions (37) in order to accommodate a wide variety of seating surfaces, furniture types, dimensions, and available space considerations.

Using the various controls in this manner, the user will manipulate and control the upward, downward, and lateral movement of the Outriggers (36) until the Outrigger Extensions (37) are in contact with an existing weight bearing surface for example, the floor or in some cases the seating surface itself, for example, a bed, chair, sofa, etc. An example is illustrated in FIG. 16(B) of the drawings.

With the Outrigger Extensions (37) so positioned in contact with a suitable weight bearing surface, the user will then use the Lift Arm Locking Bolt Switch (72) as shown in FIG. 11 of the drawings to activate the Locking Bolt Actuator Motor (54) to cause the Locking Bolt Actuator (53) to contract, thus applying an upward force to the Lift Arm Locking Bolt (51) and causing the Lift Arm Locking Bolt (51) to slide upward through the Locking Bolt Slide (52) until the Lift Arm Locking Bolt (51) is fully disengaged from the Lock Bolt Receiver (24) as illustrated in FIG. 8 of the drawings, at which point the Lift Arm (41) will no longer be secured in the fully upright and vertical position.

As the Lift Arm (41) is now free to move, its lower end will rotate around the Outrigger Fulcrum Bar (33), allowing the Lift Arm Extension (42) connected at its upper end to gently lower the user into a seated position upon the desired seating surface by his or her manipulation of either the First Main Actuator In/Out Switch (73) as shown in FIG. 11 of the drawings or the Second Main Actuator In/Out Switch (76) as shown in FIG. 12 of the drawings to activate the Main Actuator Motor (48) causing the Main Linear Actuator (47) to extend.

What has been described and illustrated herein is an embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

While the disclosed subject matter has been described with respect to a limited number of embodiments, the specific features of one embodiment should not be attributed to other embodiments of the disclosed subject matter. No single embodiment is representative of all aspects of the disclosed subject matter. Moreover, variations and modifications therefrom exist. For example, the disclosed subject matter described herein may comprise other components. Various additives may also be used to further enhance one or more properties. In some embodiments, the disclosed subject matter is substantially free of any additive not specifically enumerated herein. Some embodiments of the disclosed subject matter described herein consist of or consist essentially of the enumerated components. In addition, some embodiments of the methods described herein consist of or consist essentially of the enumerated steps. The claims to be appended later intend to cover all such variations and modifications as falling within the scope of the disclosed subject matter.

What is claimed is:

1. An independent personal lift device comprising:

a base;

one or more lift arms rotatably attached to said base, wherein said lift arms are capable of lifting a user from a seated position to a standing position; and an outrigger assembly rotatably attached to said base, wherein said outrigger assembly stabilizes said lift device while said lift device is lifting the user from the seated position to the standing position or from the standing position to the seated position, wherein said outrigger assembly can be raised and lowered; and a main linear actuator attached at a first end to said one or more lift arms and at a second end to said outrigger assembly such that said main linear actuator can be extended or contracted to move an end of said lift arm closer to or further from an end of said outrigger to change the user's position between standing and sitting;

wherein said personal lift device safely lifts the user from the seated position to the standing position or from the standing position to the seated position without the need for supervision or assistance, and wherein said personal lift device can be safely maneuvered by the user without the need for supervision or assistance;

further comprising a fulcrum, wherein said one or more lift arms and said outrigger assembly utilize said fulcrum.

2. The lift device of claim 1, wherein said base comprises:
a drive carriage assembly;
a trailing cart assembly pivotably connected to said drive carriage assembly; and
one or more wheels attached to the bottom of said base.

3. The lift device of claim 1, wherein said base is motorized.

4. The lift device of claim 2, wherein said drive carriage assembly is removable from said base.

5. The lift device of claim 2, wherein said trailing cart assembly is pivotably connected to said drive carriage assembly by a connecting pin.

6. The lift device of claim 2, wherein said trailing cart assembly comprises a steering limiter.

7. The lift device of claim 1, wherein said outrigger assembly stabilizes said lift device without increasing a counterbalance weight.

8. The lift device of claim 1, wherein said outrigger assembly can be lowered into contact with any weight-supporting surface.

9. The lift device of claim 1, wherein said outrigger assembly comprises outrigger extensions.

10. The lift device of claim 9, wherein said outrigger extensions are removable.

11. The lift device of claim 1, wherein said one or more lift arms comprises lift arm extensions.

12. The lift device of claim 11, wherein said lift arm extensions connect to a support component selected from the group of: an adjustable belt, a sling, a harness, and a combination thereof.

13. The lift device of claim 1, further comprising one or more knee braces.

14. The lift device of claim 13, wherein said one or more knee braces is a shelf.

15. The lift device of claim 13, wherein said one or more knee braces are easily removable.

16. The lift device of claim 1, further comprising a control assembly, said control assembly controlling one or more of said base and said main linear actuator.

17. The lift device of claim 16, wherein said control assembly is moveable and/or remote.

18. The lift device of claim 1, further wherein said personal lift device comprises a locking bolt mechanism, wherein said locking bolt mechanism directs force to either said outrigger assembly or said one or more lift arms.

19. An independent personal lift device comprising:
a motorized and steerable drive carriage assembly, said drive carriage assembly comprising:
a body;
a connecting pin mounted on said body;
one or more motorized drive wheels attached to said body such that they can move said body about a surface; and
a steering limiter attached to said body;
a trailing cart assembly pivotably connected to said drive carriage assembly, wherein said trailing cart assembly is pulled and steered by said drive carriage assembly; said trailing cart assembly comprising:
a connecting bearing, said connecting bearing configured to accept and support said connecting pin of said drive carriage assembly;
one or more steering stops, said one or more steering stops configured to be engaged by said steering limiter to limit a range of pivot of said drive carriage assembly relative to said trailing cart assembly;
one or more support block receivers;
one or more lock bolt receivers;
a standing platform, said standing platform capable of supporting a user;
one or more trailing wheels, said one or more trailing wheels supporting said trailing cart assembly and allowing said trailing cart assembly to move about a surface;
a power supply, said power supply providing electrical power to one or more of the electrical components of said personal lift device;
one or more knee brace receivers; and
one or more knee brace fastener receivers;
an outrigger assembly attached to said trailing cart assembly, said outrigger assembly comprising:
one or more support blocks, said one or more support blocks configured such that said support block receivers on said trailing cart receives and supports said support blocks;
an outrigger fulcrum bar, wherein said one or more support blocks are pivotably attached to said outrigger fulcrum bar such that said outrigger fulcrum bar is secured to said trailing cart, yet said outrigger assembly is allowed to pivot freely about an axis created by said outrigger fulcrum bar;
a pair of outrigger blocks, said outrigger blocks attached to each end of said outrigger fulcrum bar, each of said outrigger blocks comprising:
an outrigger lateral hinge;
a pair of outriggers, wherein said outriggers are attached to said lateral hinges such that an unattached ends of said outriggers are free to move outwardly away from said trailing cart assembly and inwardly to a position in line with parallel sides of the trailing cart assembly; and
an outrigger lever attached to an approximate midpoint of said outrigger fulcrum bar between said support blocks, wherein said outrigger lever extends forward in a substantially opposite direction relative to said outriggers, wherein said outrigger lever is configured such that a downward force on said outrigger lever is converted to upward force on said outriggers and an upward force on said outrigger lever is converted to a downward force on said outriggers as said outrigger fulcrum bar pivots through said two support blocks attached to said trailing cart assembly;
a lift arm assembly pivotably attached to said outrigger assembly, said lift arm assembly comprising:
a lift arm connected to said outrigger fulcrum bar on a lower end of said lift arm such that an upper end of said lift arm pivots forward away from the user and backward toward the user;
a main linear actuator attached at a first end to said lift arm and at a second end to said outrigger lever such that said main linear actuator can be extended or contracted to move an end of said lift arm closer to or further from an end of said outrigger to change a user's position between standing and sitting;
a lift arm locking bolt assembly attached to said lift arm assembly, said lift arm locking bolt assembly comprising:
a locking bolt slide attached to the lower end of said lift arm;
a lift arm locking bolt, said lift arm locking bolt slides up and down through said locking bolt slide such that when said lift arm locking bolt is in a locked position, said lift arm locking bolt extends downward through said lock bolt receiver of said trailing cart assembly; and a locking bolt actuator connected at its lower end to said lift arm locking bolt, wherein said locking bolt actuator allows the user to easily lock and unlock said lift arm locking bolt;

a knee brace assembly attached to said trailing cart assembly, said knee brace assembly comprising:

one or more knee braces;

knee padding attached to each of said one or more knee braces to provide comfort for the user;

one or more knee brace supports insertable into said knee brace receivers on said trailing cart assembly to provide support for said knee brace; and one or more knee brace fasteners insertable into said knee brace fastener receivers on said trailing cart assembly to secure said knee brace supports;

a control assembly attached to said lift arm assembly, said control assembly allowing the user to control said motorized drive wheels, said main linear actuator and said lift arm locking bolt; and a user connection group connectable to said lift arm assembly such that said user connection group allows the user to comfortably use said lift device.

* * * * *